US011358773B2

(12) United States Patent
Kim et al.

(10) Patent No.: US 11,358,773 B2
(45) Date of Patent: Jun. 14, 2022

(54) MEDICATION PACKAGING AND DISPENSING SYSTEM

(71) Applicant: AbbVie Inc., North Chicago, IL (US)

(72) Inventors: Lori Kim, Green Oaks, IL (US); Alexandra Breban-Lopez, Northbrook, IL (US); Bhimaprasad Medhal, Lake Forest, IL (US); Dejan Bojicic, Chicago, IL (US); Guy Upchurch, Chicago, IL (US); John G. Finch, Vernon Hills, IL (US); Lewis Sita, Kildeer, IL (US)

(73) Assignee: ABBVIE INC., North Chicago, IL (US)

( * ) Notice: Subject to any disclaimer, the term of this patent is extended or adjusted under 35 U.S.C. 154(b) by 0 days.

(21) Appl. No.: 16/932,181

(22) Filed: Jul. 17, 2020

(65) Prior Publication Data

US 2020/0346830 A1 Nov. 5, 2020

Related U.S. Application Data

(62) Division of application No. 15/294,050, filed on Oct. 14, 2016, now Pat. No. 10,737,863.

(Continued)

(51) Int. Cl.
*B65D 5/50* (2006.01)
*B65D 77/04* (2006.01)

(Continued)

(52) U.S. Cl.
CPC ..... *B65D 77/04* (2013.01); *A61J 1/035* (2013.01); *A61J 7/04* (2013.01); *B65D 5/4266* (2013.01);

(Continued)

(58) Field of Classification Search
CPC .... B65D 5/526; B65D 5/5273; B65D 5/5266; B65D 5/5213; B65D 2577/042;

(Continued)

(56) References Cited

U.S. PATENT DOCUMENTS 1,042,935 A 10/1912 Lines
1,120,238 A 12/1914 Porter (Continued)

FOREIGN PATENT DOCUMENTS

EP 1964788 A1 9/2008
EP 1349727 B1 12/2010

(Continued)

OTHER PUBLICATIONS

PCT International Search Report and Written Opinion, Application No. PCT/US2016/057360, dated Mar. 29, 2017, 17 pps.

(Continued)

*Primary Examiner* — Allan D Stevens
(74) *Attorney, Agent, or Firm* — Armstrong Teasdale LLP

(57) ABSTRACT

A medication packaging and dispensing system is provided. The system may include a plurality of medication booklets containing medication and a tray that is configured to retain the medication booklets. Each medication booklet may include a sequential tab assembly of pull tabs that aligns with a plurality of front cutouts and a plurality of back cutouts. This alignment configuration facilitates dispensing the medication from the medication booklet. The tray may include a riser that extends from a bottom wall of the tray at an oblique angle, and a first guide panel including a plurality of linear stops. The oblique angle may correspond to a pitch of the first guide panel. The riser and the plurality of linear stops may cooperate to maintain the medication booklets in a staggered configuration that is substantially parallel to the bottom wall of the tray. The system may further include a container for retaining the tray.

12 Claims, 23 Drawing Sheets

Related U.S. Application Data

(60) Provisional application No. 62/243,436, filed on Oct. 19, 2015.

(51) Int. Cl.

| | |
|---|---|
| ***B65D 83/04*** | (2006.01) |
| ***A61J 1/03*** | (2006.01) |
| ***A61J 7/04*** | (2006.01) |
| ***B65D 5/42*** | (2006.01) |
| ***B65D 75/36*** | (2006.01) |
| ***B65D 77/22*** | (2006.01) |
| *B65D 77/00* | (2006.01) |

(52) U.S. Cl.

CPC ..... *B65D 75/367* (2013.01); *B65D 77/0413* (2013.01); *B65D 77/22* (2013.01); *B65D 83/0463* (2013.01); *B65D 77/006* (2013.01); *B65D 2577/045* (2013.01); *B65D 2583/0409* (2013.01)

(58) Field of Classification Search

CPC ..... B65D 2577/045; B65D 77/042; B65D 25/107; B65D 25/10; B65D 85/48; B65D 85/62

USPC .... 229/104, 120.08, 120.12, 120.15, 120.16, 229/120.17, 120.18, 120.35; 220/557

See application file for complete search history.

(56) References Cited

U.S. PATENT DOCUMENTS

| | | | | |
|---|---|---|---|---|
| 1,610,834 | A | 12/1926 | Webster | |
| 1,764,216 | A * | 6/1930 | Laubenheimer | B65D 5/4216 206/740 |
| 1,916,227 | A * | 7/1933 | Lorenzen | B65D 5/524 206/561 |
| 1,977,466 | A | 10/1934 | Bohnke | |
| 2,018,824 | A * | 10/1935 | Wilke | B65D 5/5266 206/744 |
| 2,078,018 | A * | 4/1937 | Powell | B65D 5/5213 206/756 |
| 2,103,241 | A | 12/1937 | Bell | |
| 2,430,166 | A | 11/1947 | Fish et al. | |
| 2,502,561 | A | 4/1950 | Ebert | |
| 2,801,754 | A | 8/1957 | Dorfman | |
| 3,305,077 | A | 2/1967 | Greif et al. | |
| 3,308,934 | A | 3/1967 | Reiner | |
| 3,659,707 | A | 5/1972 | Nilsson et al. | |
| 3,911,606 | A | 10/1975 | Hunkins | |
| 4,034,908 | A * | 7/1977 | Forbes, Jr. | B65D 5/5016 229/120.08 |
| 4,228,904 | A | 10/1980 | Dumond | |
| 4,304,354 | A | 12/1981 | Shermer | |
| 5,310,060 | A | 5/1994 | Bitner et al. | |
| D384,578 | S | 10/1997 | Wangu et al. | |
| D385,112 | S | 10/1997 | Birnbaum | |
| D391,156 | S | 2/1998 | Stevens | |
| 5,785,180 | A | 7/1998 | Dressel et al. | |
| D404,641 | S | 1/1999 | Kelsey et al. | |
| 5,878,888 | A | 3/1999 | Faughey et al. | |
| 6,024,222 | A | 2/2000 | Assargren et al. | |
| 6,131,738 | A | 10/2000 | Dejonge | |
| 6,138,830 | A | 10/2000 | Muggli | |
| 6,161,699 | A | 12/2000 | Gartland | |
| 6,273,260 | B1 | 8/2001 | Coldepietro et al. | |
| 6,345,717 | B1 | 2/2002 | Flewitt | |
| 6,543,209 | B1 | 4/2003 | Siegel et al. | |
| 6,565,228 | B2 | 5/2003 | Nguyen | |
| 6,659,280 | B2 | 12/2003 | Paliotta et al. | |
| 6,708,825 | B2 | 3/2004 | Filion et al. | |
| 6,805,258 | B2 | 10/2004 | Cross | |
| 6,951,282 | B2 | 10/2005 | Jones | |
| 7,243,798 | B2 | 7/2007 | Buss et al. | |
| 7,331,460 | B2 | 2/2008 | Barndt et al. | |
| 7,401,702 | B2 | 7/2008 | Hession | |
| 7,489,594 | B2 | 2/2009 | Simon et al. | |
| 7,497,331 | B2 | 3/2009 | Pham | |
| 7,658,287 | B2 | 2/2010 | Hession | |
| 7,699,173 | B2 | 4/2010 | Hession et al. | |
| 7,780,007 | B2 | 8/2010 | Baker | |
| D626,830 | S | 11/2010 | Ivic et al. | |
| 7,891,492 | B2 | 2/2011 | Wenninger et al. | |
| 7,905,355 | B2 | 3/2011 | Williams-Hartman | |
| 8,011,512 | B2 | 9/2011 | Brollier et al. | |
| 8,091,708 | B2 | 1/2012 | Loftin et al. | |
| D658,882 | S | 5/2012 | Cullen | |
| 8,191,710 | B2 | 6/2012 | Clarke | |
| 8,317,017 | B2 | 11/2012 | Edwards et al. | |
| 8,479,921 | B2 | 7/2013 | Ingraham | |
| 8,596,460 | B2 | 12/2013 | Scatterday | |
| D700,070 | S | 2/2014 | Markovic | |
| D703,551 | S | 4/2014 | Takeda et al. | |
| 8,695,848 | B2 | 4/2014 | Cook et al. | |
| D721,577 | S | 1/2015 | Scatterday | |
| 8,991,605 | B2 | 3/2015 | Busch | |
| 8,991,607 | B2 | 3/2015 | Wagner et al. | |
| 9,643,772 | B2 * | 5/2017 | Yue | B65D 85/48 |
| 2002/0162768 | A1 | 11/2002 | Bolnick et al. | |
| 2003/0168376 | A1 | 9/2003 | Taneja et al. | |
| 2003/0213721 | A1 | 11/2003 | Jones | |
| 2004/0188312 | A1 | 9/2004 | Stepowany | |
| 2004/0211739 | A1 * | 10/2004 | Lembe | A47F 5/0025 211/133.1 |
| 2004/0226987 | A1 * | 11/2004 | Siurek | A47F 5/112 229/101 |
| 2005/0211597 | A1 | 9/2005 | Penfold et al. | |
| 2007/0068843 | A1 | 3/2007 | Hession | |
| 2007/0151893 | A1 | 7/2007 | Barndt et al. | |
| 2008/0105586 | A1 | 5/2008 | Baker | |
| 2008/0200321 | A1 | 8/2008 | Bittner et al. | |
| 2008/0277311 | A1 | 11/2008 | Wang et al. | |
| 2009/0139893 | A1 | 6/2009 | McGonagle et al. | |
| 2010/0012544 | A1 | 1/2010 | Paliotta et al. | |
| 2010/0213097 | A1 | 8/2010 | Paliotta et al. | |
| 2012/0160735 | A1 | 6/2012 | Waidelich | |
| 2012/0193904 | A1 | 8/2012 | Ludwig et al. | |
| 2014/0034535 | A1 | 2/2014 | Greyshock et al. | |
| 2014/0262839 | A1 | 9/2014 | Le et al. | |
| 2014/0305834 | A1 | 10/2014 | Knutson et al. | |
| 2016/0009453 | A1 * | 1/2016 | Yue | B65D 25/10 206/706 |
| 2016/0143807 | A1 | 5/2016 | Ika et al. | |
| 2017/0112719 | A1 | 4/2017 | O'Dwyer et al. | |
| 2018/0186501 | A1 * | 7/2018 | Rodrigues | B65D 5/6602 |

FOREIGN PATENT DOCUMENTS

| | | | | |
|---|---|---|---|---|
| EP | 2028115 | B1 | 2/2011 | |
| GB | 200712 | A * | 7/1923 | B65D 5/5266 |
| GB | 348408 | A * | 5/1931 | B65D 5/5213 |
| GB | 473204 | A * | 10/1937 | B65D 5/5213 |
| JP | 2000109152 | A | 4/2000 | |
| JP | 2005520656 | A | 7/2005 | |
| JP | 03159413 | U | 5/2010 | |
| KR | 20110006625 | U | 6/2011 | |
| WO | 0107012 | A1 | 2/2001 | |
| WO | 2011029422 | A2 | 3/2011 | |
| WO | 2013020573 | A1 | 2/2013 | |
| WO | WO-2018019521 | A1 * | 2/2018 | B65D 5/4204 |

OTHER PUBLICATIONS

European Search Report for related European Patent Application No. 19219546, dated Mar. 20, 2020, 2 pages.

* cited by examiner

MEDICATION PACKAGING AND DISPENSING SYSTEM

CROSS-REFERENCE TO RELATED APPLICATIONS

This application is a divisional application of U.S. patent application Ser. No. 15/294,050, filed Oct. 14, 2016, which claims the benefit of priority to U.S. Provisional Patent Application No. 62/243,436, filed Oct. 19, 2015, the entire content and disclosure of each of which are hereby incorporated by reference herein in their entirety.

BACKGROUND

The disclosed subject matter relates to packaging and, more particularly, to systems for packaging and dispensing medication, the systems having improved compliance features.

Medication containers are designed with many considerations in mind, including child resistance and ease of access for users, particularly seniors, which can be contradictory considerations. At least some known medications are packaged in blister cards and/or paperboard containers, which may be more convenient than medicine bottles with caps that lock as a child-resistant feature. It would be desirable for a medication package to have the convenience of a paperboard container with additional child-resistant features to prevent unwanted access to the medication.

Moreover, there are additional considerations when packaging medications with specific, strict, or complex compliance requirements, such as medications that a healthcare provider may require be taken in a certain order. The packaging may provide safety warnings or include instructional materials, but these may be easily ignored, either consciously or unconsciously. Accordingly, it would be desirable for a medication package to make compliance requirements clearer and/or more difficult for a user to avoid.

BRIEF DESCRIPTION OF THE DISCLOSURE

In one aspect, a blank for constructing a medication booklet is provided. The blank includes a plurality of panels coupled together along a plurality of fold lines. The plurality of panels includes an inner front panel comprising a plurality of front cutouts defined therein, an outer front panel comprising a sequential tab assembly including a plurality of pull tabs, and a back panel comprising a plurality of back cutouts defined therein. Each pull tab of the plurality of pull tabs substantially aligns with an associated front cutout of the plurality of front cutouts and an associated back cutout of the plurality of back cutouts, when the medication booklet is formed from the blank.

In another aspect, a medication booklet is provided, including a top wall and an opposing bottom wall. The top wall includes an outer panel including a sequential tab assembly, the sequential tab assembly including a plurality of pull tabs, and an inner panel coupled in a face-to-face relationship with the outer panel, the inner panel including a plurality of front cutouts defined therein. Each pull tab of the plurality of pull tabs substantially aligns with an associated front cutout of the plurality of front cutouts. The bottom wall includes a plurality of back cutouts defined therein, wherein each pull tab of the plurality of pull tabs further substantially aligns with an associated back cutout of the plurality of back cutouts.

In a further aspect, a method for forming a medication booklet from a blank is provided. The blank includes a plurality of panels coupled together along a plurality of fold lines. The plurality of panels includes an inner front panel including a plurality of front cutouts defined therein, an outer front panel including a sequential tab assembly including a plurality of pull tabs, a first side panel, and a back panel including a plurality of back cutouts defined therein. The method includes rotating the inner front panel about a fold line into a face-to-face relationship with the outer front panel, such that each pull tab of the sequential tab assembly is substantially aligned with an associated front cutout of the plurality of front cutouts. The method further includes rotating the first side panel about a fold line into a substantially perpendicular relationship with the back panel, and rotating the outer front panel about a fold line into a substantially parallel relationship with the back panel, such that each of the front cutouts is substantially aligned with an associated back cutout of the plurality of back cutouts.

In yet another aspect, a blank for constructing a tray is provided. The blank includes a plurality of panels coupled together along a plurality of generally parallel fold lines. The plurality of panels includes a first outer side panel, a bottom panel, and a riser panel. The blank further includes a first end panel extending from a first end edge of the first outer side panel, and a first guide panel extending from a top edge of the first end panel, the first guide panel including a plurality of linear stops along a free edge thereof. The riser panel is oriented at an oblique angle with respect to the bottom panel when the tray is formed from the blank, the oblique angle corresponding to a pitch of the first guide panel.

In another aspect, a tray is provided, the tray including a first end wall, a first side wall extending from a side edge of the first end wall, a bottom wall extending from a bottom edge of the first side wall, a riser extending an oblique angle from the bottom wall, and a first guide panel coupled in a face-to-face relationship with the first end wall. The first guide panel includes a plurality of linear stops along a free edge thereof. The oblique angle of the riser corresponds to a pitch of the free edge of the first guide panel, such that the riser and at least one of the plurality of linear stops of the first guide panel cooperate to orient contents of the tray substantially parallel to the bottom wall.

In a further aspect, a method of forming a tray from a blank is provided. The blank includes a plurality of panels coupled together along a plurality of generally parallel fold lines, the plurality of panels including a first outer side panel, a bottom panel, and a riser panel. The blank further includes a first end panel extending from a first end edge of the first outer side panel and a first guide panel extending from a top edge of the first end panel, the first guide panel including a plurality of linear stops along a free edge thereof. The method includes rotating the first outer side panel into a substantially perpendicular relationship with the bottom panel, rotating the first guide panel into a face-to-face relationship with the first end panel, and rotating the first end panel into a substantially perpendicular relationship with the first outer side panel. The method further includes rotating the riser panel about a fold line to position the riser panel at an oblique angle with respect to the bottom panel, wherein the oblique angle of the riser panel corresponds to a pitch of the first guide panel.

In yet another aspect, a medication packaging and dispensing system is provided. The system includes a first medication booklet containing medication therein, a second medication booklet containing medication therein, and a tray configured to retain the first and second medication booklets. The first medication booklet includes a top wall and an opposing bottom wall. The top wall of the first medication booklet includes an outer panel including a sequential tab assembly including a plurality of pull tabs, and an inner panel coupled in a face-to-face relationship with the outer panel. The inner panel includes a plurality of front cutouts defined therein, wherein each pull tab of the plurality of pull tabs substantially aligns with an associated front cutout of the plurality of front outs. The bottom wall includes a plurality of back cutouts defined therein, wherein each pull tab of the plurality of pull tabs further substantially aligns with an associated back cutout of the plurality of back cutouts to facilitate dispensing the medication therethrough. The tray includes a first end wall, a first side wall extending from a side edge of the first end wall, a bottom wall extending from a bottom edge of the first side wall, a riser extending at an oblique angle from the bottom wall, and a first guide panel coupled in a face-to-face relationship with the first end wall. The first guide panel includes a plurality of linear stops along a free edge thereof. The riser and at least one of the plurality of linear stops of the first guide panel cooperate to maintain the first medication booklet in a staggered configuration with respect to the second medication booklet.

BRIEF DESCRIPTION OF THE DRAWINGS

FIGS. 1-29 show example embodiments of the methods and systems described herein.

FIG. 1 is a top plan view of a first example embodiment of a blank for forming a medication booklet, for use with the medication packaging and dispensing system shown in FIGS. 24-29.

FIG. 2 is a top plan view of a second example embodiment of a blank for forming a medication booklet, for use with the medication packaging and dispensing system shown in FIGS. 24-29.

FIG. 3 is a top plan view of a third example embodiment of a blank for forming a medication booklet, for use with the medication packaging and dispensing system shown in FIGS. 24-29.

FIG. 4 is a top plan view of a fourth example embodiment of a blank for forming a medication booklet, for use with the medication packaging and dispensing system shown in FIGS. 24-29.

FIG. 5 is a perspective view of a first example embodiment of a puck for use with the medication packaging and dispensing system shown in FIGS. 24-29.

FIG. 6 is a perspective view of a second example embodiment of a puck for use with the medication packaging and dispensing system shown in FIGS. 24-29.

FIG. 7 is a perspective view of a first surface of an example embodiment of a medication blister card adhered to the puck shown in FIG. 5.

FIG. 8 is a perspective view of a second surface of the medication blister card shown in FIG. 7.

FIGS. 9 and 10A are perspective views illustrating formation of a first embodiment of a medication booklet shown in FIGS. 11-14 using the blank shown FIG. 1, and the puck and medication blister card shown in FIGS. 7 and 8.

FIG. 11 is a top view of a first example embodiment of a medication booklet for use with the medication packaging and dispensing system shown in FIGS. 24-29.

FIG. 12 a bottom view of the medication booklet shown in FIG. 11.

FIG. 13 is a perspective view of the medication booklet shown in FIGS. 11 and 12 in an open configuration.

FIG. 14 is an enlarged view of the medication booklet shown in FIGS. 11-13, illustrating a sequential tab assembly.

FIG. 15B is a bottom view of the medication booklet shown in

FIG. 15A.

FIG. 16B is a bottom view of the medication booklet shown in

FIG. 16A.

FIG. 17B is a bottom view of the medication booklet shown in

FIG. 17A.

FIG. 18 illustrates a top plan view of a blank for constructing a tray for use with the medication packaging and dispensing system shown in FIGS. 24-29.

FIG. 19 is a perspective view of a tray formed from the blank shown in FIG. 18.

FIG. 20 is a top plan view of an example embodiment of a blank for forming a container for use with the medication packaging and dispensing system shown in FIGS. 24-29.

FIG. 21 is a perspective view of a container formed from the blank shown in FIG. 20.

FIG. 22 is a perspective view of the container shown in FIG. 21 in an intermediate open configuration.

FIG. 23 is a perspective view of the container shown in FIGS. 21 and 22 in a fully open configuration.

FIG. 24 is a perspective view of a medication packaging and dispensing system including the medication booklets shown in FIGS. 11-17B, the tray shown in FIG. 19, and the container shown in FIGS. 21-23.

FIG. 25 is a first view of the medication packaging and dispensing system shown in FIG. 24 in a fully open configuration, illustrating a "full" or "complete" medication packaging and dispensing system.

FIG. 26 is a second view of the medication packaging and dispensing system shown in FIGS. 24 and 25 in the fully open configuration, illustrating an "empty" medication packaging and dispensing system.

FIG. 27 is a third view of the medication packaging and dispensing system shown in FIGS. 24-26 in the fully open configuration, illustrating a "first packaging stage" or "final dispensing stage."

FIG. 28 is a fourth view of the medication packaging and dispensing system shown in FIGS. 24-27 in the fully open configuration, illustrating an "intermediate packaging stage" or "intermediate dispensing stage."

FIG. 29 is a fifth view of the medication packaging and dispensing system shown in FIGS. 24-28 in the fully open configuration, illustrating another "intermediate packaging stage" or "intermediate dispensing stage."

Like numbers in the Figures indicate the same or functionally similar components.

DETAILED DESCRIPTION OF THE DISCLOSURE

Figure 1:
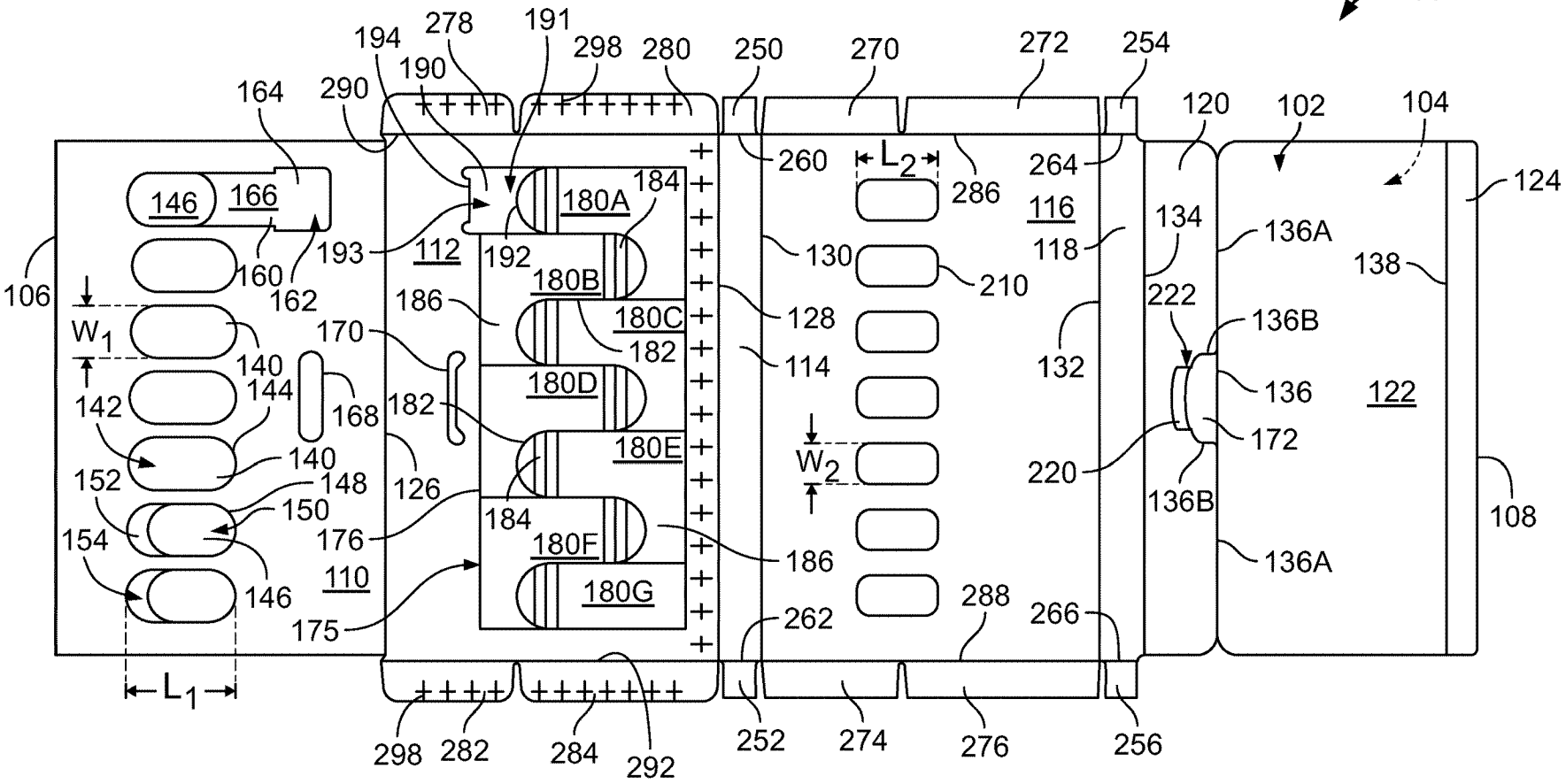

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The embodiments described herein provide a system for packaging and dispensing medication. The system includes a container formed from a first blank of sheet material and a tray formed from a second blank of sheet material. The system also includes one or more cartons or "booklets" including the medication therein. Each booklet is formed from a single blank of sheet material, a puck, and a blister card. Methods for constructing the container, tray, and booklet(s) are also provided. Any or all of the container, the tray, and the booklet(s) may be constructed using a machine and/or by hand.

In the example embodiment, the system is configured to improve user compliance with a prescribed treatment regimen requiring strict user adherence. For example, the treatment regimen may be designed to build user tolerance to a prescribed medication from an initial dose level to a "maintenance" dose level. Each medication booklet contains medication doses for a specific time period during this "tolerance-building" regimen. In the example embodiment, each medication booklet is designed to contain a single week's worth of medication doses, or seven daily doses in each booklet. The tray is configured to retain four medication booklets therein, each containing medication with an increasing dose level. For example, the first-week booklet may contain 20 milligram (mg) doses, the second-week booklet may contain 50 mg doses, the third-week booklet may contain 100 mg doses, and the fourth-week booklet may contain 200 mg doses. As such, the booklets may include medication dosages having various sizes and/or different shapes. In some embodiments, the medication in the medication booklets disclosed herein may have any suitable, size, shape, and/or color, include any suitable active agent(s), and may be used to treat various disorders/diseases. The design of the tray is configured to improve user compliance in taking the medication by displaying the medication booklets in a clearly sequential arrangement. Moreover, each medication booklet includes improved compliance features configured to ensure users take the appropriate daily dose each day.

In one embodiment, the first blank for constructing the container and the blank(s) for constructing the booklet(s) are fabricated from a paperboard material. The first blank and/or any of the blank(s) for constructing the booklet(s), however, may be fabricated using any suitable material, and therefore are not limited to a specific type of material. The materials used in manufacturing the blank may be configured to maintain a moisture level to protect and maintain the medication. In alternative embodiments, any of these blanks are fabricated using cardboard, corrugated cardboard, plastic, fiberboard, foamboard, corrugated paper, and/or any suitable material known to those skilled in the art and guided by the teachings herein provided.

In one embodiment, the second blank for constructing the tray is fabricated from a corrugated cardboard material. The blank, however, may be fabricated using any suitable material, and therefore is not limited to a specific type of material. In alternative embodiments, the blank is fabricated using cardboard, plastic, fiberboard, paperboard, foamboard, corrugated paper, and/or any suitable material known to those skilled in the art and guided by the teachings herein provided.

In one embodiment, any or all of the blank(s) for constructing the container, tray, and/or booklet(s) include at least one marking thereon including, without limitation, indicia that communicates the product, a manufacturer of the product, and/or a seller of the product. For example, the marking may include printed text, logos, and/or color schemes that indicate a product name and briefly describe the product, logos, and/or trademarks that indicate a manufacturer and/or seller of the product, designs and/or ornamentation that attract attention, warning and/or safety labels, instructions for use, and/or any other indicia. "Printing," "printed," and/or any other form of "print" as used herein may include, but is not limited to including, ink jet printing, laser printing, multidimensional printing (e.g., 3D printing), screen printing, giclée, pen and ink, painting, offset lithography, flexography, relief print, rotogravure, dye transfer, and/or any suitable printing technique known to those skilled in the art and guided by the teachings herein provided. In some embodiments, any or all of the blank(s) may include one or more features configured to identify, track, and/or allow the user of the system to send and/or receive information regarding the medication (e.g., side-effects, contact information of the prescriber and/or medication manufacturer, ingredients, and/or other information). Examples of features configured to identify, track, and/or allow the user of the system to send and/or receive information may include: scannable images (e.g., bar codes, quick response (QR) codes), radio frequency identification (RFID) tags, website addresses, phone numbers, and/or any other suitable feature(s). These features may allow a user to better understand the medication regimen and also may allow healthcare providers access to adherence and compliance information. The adherence and compliance information may be electronically received and stored in accordance with relevant patient privacy regulations for categorization, and stored with patients with similar data for later retrieval and processing, for example, to determine use, adherence, and/or compliance data for a population of patients. In another embodiment, the blank is void of markings, such as, without limitation, indicia that communicates the product, a manufacturer of the product and/or a seller of the product.

FIG. 1 is a top plan view of a first example embodiment of a blank 100 for forming a medication booklet 800 (shown in FIGS. 11-14). In the example embodiment of the medication packaging and dispensing system 2000 (e.g., as shown in FIG. 24-29), blank 100 forms medication booklet 800, which contains a first set of medication doses. Medication booklet 800, as described herein, is configured to contain prescription medication that is required and/or prescribed to be taken over a specific period of time (in the example embodiment, a week). Blank 100 has a first or interior surface 102 and an opposing second or exterior surface 104. Further, blank 100 defines a first or leading edge 106 and an opposing second or trailing edge 108. In the illustrated embodiment, blank 100 includes, from leading edge 106 to trailing edge 108, an inner front panel 110, an outer front panel 112, a first side panel 114, a back panel 116, a second side panel 118, a front glue panel 120, a cover panel 122, and a side glue panel 124. Panels 110, 112, 114, 116, 118, 120, 122, and 124 are coupled together by a plurality of generally parallel fold lines 126, 128, 130, 132, 134, 136, and 138. More specifically, inner front panel 110 extends from leading edge 106 to fold line 126, outer front panel 112 extends from fold line 126, first side panel 114 extends from fold line 128, back panel 116 extends from fold line 130, second side panel 118 extends from fold line 132, front glue panel 120 extends from fold line 134, cover panel 122 extends from fold line 136, and side glue panel 124 extends from fold line 138 to trailing edge 108. Fold lines 126, 128, 130, 132, 134, 136, and 138, as well as other fold lines and/or hinge lines described herein, may include any suitable line of weakening and/or line of separation known to those skilled in the art and guided by the teachings herein provided. In particular, in the illustrated embodiment, fold line 136 is at least partially formed as lines of weakness 136A, such as perforation lines, score lines, or cut lines, enabling removal or de-coupling of cover panel 122 from front glue panel 120 along perforation lines 136A to open booklet 800 formed from blank 100.

In the illustrated embodiment, inner front panel 110 includes a plurality of front cutouts 140. Each front cutout 140 includes an area 142 defined by a perimeter 144 of front cutout 140. In the illustrated embodiment, front cutouts 140 have a length $L_1$ and a width $W_1$. Although front cutouts 140 are illustrated as having a "stadium" shape (e.g., a rectangle with semi-circles at opposite ends thereof), front cutouts 140 may have any other suitable shape that enables blank 100 and medication booklet 800 to function as described herein, such as, for example, rectangles, rounded rectangles, ovals, ellipses, circles, etc.

In some embodiments, one or more of front cutouts 140, or a "subset" of the front cutouts 140, includes a reminder tab 146. Reminder tab 146 is coupled to front cutout 140 along a perforation line 148 that extends along at least a portion of perimeter 144 of front cutout 140, enabling removal or de-coupling of reminder tab 146 from front cutout 140. In the illustrated embodiment, reminder tab 146 has a surface area 150 less than area 142 of front cutout 140, such that front cutout 140 further includes an access opening 152 defined therein. An area 154 of access opening 152 is approximately a remainder of area 142 of front cutout 140 not occupied by surface area 150 of reminder tab 146. Access opening 152 enables a user of medication booklet 800 formed from blank 100 to access interior surface 102 of reminder tab 146 and de-couple reminder tab 146 from front cutout 140 along perforation line 148, by exerting a force on reminder tab 146. In alternative embodiments, reminder tab 146 has a surface area substantially equal to area 142 of front cutout 140, such that reminder tab 146 substantially closes front cutout 140. The user may de-couple reminder tab 146 from front cutout 140 by, for example, inserting a wedge (e.g., a fingernail or tool) into perforation line 148 along reminder tab 146 and exerting a force on reminder tab 146.

A top front cutout 160 is elongated with respect to the other front cutouts 140. Top front cutout 160 includes a reminder tab 146, as well as an access opening 162. Access opening 162 includes a first portion 164 and a second portion 166. First portion 164 is described further herein. Second portion 166 of access opening 162 is configured to function similarly to access openings 152 described above to enable a user of medication booklet 800 to de-couple reminder tab 146 from top front cutout 160.

As described further herein, each front cutout 140, 160 is substantially aligned with a medication blister module 708 of a blister card 700 (shown in FIGS. 7 and 8), such that a user of medication booklet 800 may access medication blister module 708 through the front cutout 140, 160. In the illustrated embodiment, inner front panel 110 includes seven front cutouts 140 (including top front cutout 160), to accommodate access to seven daily medication doses.

Inner front panel 110 further includes an inner locking slot 168 defined therein. As described further herein, inner locking slot 168 is sized and shaped to receive a locking tab 172 on a free edge of cover panel 122 therein to releasably close medication booklet 800, when booklet 800 is formed from blank 100. Moreover, inner locking slot 168 is aligned with an outer locking slot 170 defined in outer front panel 112, such that locking tab 172 is received in both inner and outer locking slots 168 and 170 to releasably close booklet 800.

Outer front panel 112 includes a sequential tab assembly 175 configured to improve user compliance with a prescribed medication regimen and also may improve child resistance. In particular, sequential tab assembly 175 is configured to ensure the medication regimen is accessed (and, thereby, taken or consumed) in the prescribed order. In other words, a user is limited and in some cases prevented from accessing a "future dose" (e.g., a medication dose prescribed to be taken on a subsequent or future day, or at a future time) until the user has first accessed a "current dose" (e.g., the medication dose prescribed to be taken on a current day or at a current time). Sequential tab assembly 175 is bounded by a perforation line 176 that extends along a perimeter of sequential tab assembly 175. Sequential tab assembly 175 includes a plurality of pull tabs 180A-180G (collectively, pull tabs 180) in a serpentine arrangement, and each of pull tabs 180 is itself bounded by a perforation line 182 that extends along a perimeter thereof. Each of pull tabs 180 (except, in the illustrated embodiment, a final pull tab 180G) includes a grip portion 184 and a tail portion 186. Grip portion 184 is configured to enable a user to grip a pull tab 180 and remove that pull tab 180 from outer front panel 112. Grip portion 184 may be manufactured using any suitable material(s) and may have any suitable shape, size, or surface features. For example, portions of grip portion 184 may include contours, indentations, and/or roughened surfaces which may improve a user's ability to grip a grip portion 184. Tail portion 186 is configured to abut grip portion 184 of an adjacent (e.g., subsequent) pull tab 180. More specifically, for example, tail portion 186 of pull tab 180A is complementary to and coupled to at least a portion of grip portion 184 of subsequent pull tab 180B, such that grip portion 184 of pull tab 180B is restricted or inaccessible to the user until pull tab 180A is removed or de-coupled from sequential tab assembly 175.

An access flap 190 is disposed adjacent pull tab 180A of sequential tab assembly 175. More particularly, a first end 191 of access flap 190 is coupled to grip portion 184 of first pull tab 180A along a perforation line 192. An opposing second end 193 of access flap 190 is coupled to outer front panel 112 along a fold line 194. In alternative embodiments, fold line 194 may be a perforation line 194. When medication booklet 800 is formed from blank 100, access flap 190 is aligned with first portion 164 of access opening 162 of first front cutout 160. A user depresses access flap 190 into first portion 164 of access opening 162, de-coupling access flap 190 from grip portion 184 of first pull tab 180A along perforation line 192. Access flap 190 is displaced into access opening 162. Access flap 190 rotates about fold line 194. The user may then access grip portion 184 of first pull tab 180A, engage grip portion 184, and, by exerting a pulling force thereon, de-couple first pull tab 180A from sequential tab assembly 175 along perforation line 182 that extends along the perimeter of first pull tab 180A. When first pull tab 180A is removed, grip portion 184 of subsequent pull tab 180B is exposed and accessible to the user for subsequent removal.

In the illustrated embodiment, when medication booklet 800 is formed from blank 100, each pull tab 180 is substantially aligned with one of front cutouts 140. Accordingly, removal of a pull tab 180 exposes one of front cutouts 140 to the user. In the example embodiment, sequential tab assembly 175 includes seven pull tabs 180, to accommodate access to seven daily medication doses. The seventh or last pull tab 180G does not include a tail portion 186, because there are no additional pull tabs 180 for which pull tab 180G would prevent access. Accordingly, for aesthetic appeal and/or reduced manufacturing complexity, pull tab 180G includes no tail portion 186, such that sequential tab assembly 175 has a substantially rectangular configuration. In other embodiments, sequential tab assembly 175 has an alternative configuration that is regular (e.g., a well-defined shape) or irregular and that enables blank 100 and/or booklet 800 to function as described herein.

Back panel 116 of blank 100 includes a plurality of back cutouts 210. Back cutouts 210 have a length $L_2$ and a width $W_2$. In the illustrated embodiment, when medication booklet 800 is formed from blank 100, each back cutout 210 is substantially aligned with one of front cutouts 140. More particularly, as described further herein, each back cutout 210 is substantially aligned with a medication blister module 708 (shown in FIGS. 7 and 8), such that medication 701 contained in medication blister module 708 is dispensed through a back cutout 210 to the user. Accordingly, $L_2$ and $W_2$ may be sized appropriately to accommodate medication 701 in medication blister module 708.

In the illustrated embodiment, front glue panel 120 includes an access cutout 220 defined therein, along an edge 222 including fold line 136. Access cutout 220 is at least partially defined by opposing perforation lines 136B, which extend from perforation lines 136A into front glue panel 120. Access cutout 220 has an area that is at least partially covered or occupied by locking tab 172 that extends from cover panel 122 into access cutout 220. When booklet 800 is formed from blank 100, access cutout 220 enables the user to access interior surface 102 and/or a free edge 224 of locking tab 172 and exert a force thereon to de-couple locking tab 172 from access cutout 220 along perforation lines 136B.

Blank 100 further includes a plurality of end flaps. More particularly, first side panel 114 includes a first end flap 250 extending from a first end edge 260 of first side panel 114 and a second end flap 252 extending from an opposing second end edge 262 of first side panel 114. Similarly, second side panel 118 includes a third end flap 254 extending from a first end edge 264 of second side panel 118 and a fourth end flap 256 extending from an opposing second end edge 266 of second side panel 118.

In addition, back panel 116 includes a first inner minor end panel 270 and a first inner major end panel 272 extending from a first end edge 286 of back panel 116, and a second inner minor end panel 274 and a second inner major end panel 276 extending from an opposing second end edge 288 of back panel 116. Outer front panel 112 includes a first outer minor end panel 278 and a first outer major end panel 280 extending from a first end edge 290 of outer front panel 112, and a second outer minor end panel 282 and a second outer major end panel 284 extending from an opposing second end edge 292 of outer front panel 112. Outer end panels 278, 280, 282, and 284 include a plurality of score lines or cut lines 298 defined therein. These score lines 298 on outer end panels 278, 280, 282, and 284 may improve the child resistance of medication booklet 800 formed from blank 100. As described further herein, when booklet 800 is formed from blank 100, outer end panels 278, 280, 282, and 284 are adhered (or otherwise secured) to inner end panels 270, 272, 274, and 276. When a child (or any other person) attempts to de-couple outer end panels 278, 280, 282, and 284 from inner end panels 270, 272, 274, and 276 to access an interior of booklet 800, score lines 298 prevent the child from de-coupling any of outer end panels 278, 280, 282, and 284 "in one piece." The child would have to peel away the outer end panel 278, 280, 282, or 284 incrementally, as score lines 298 would cause outer end panel 278, 280, 282, or 284 to "rip" into multiple portions, along each score line 298.

Figure 2:
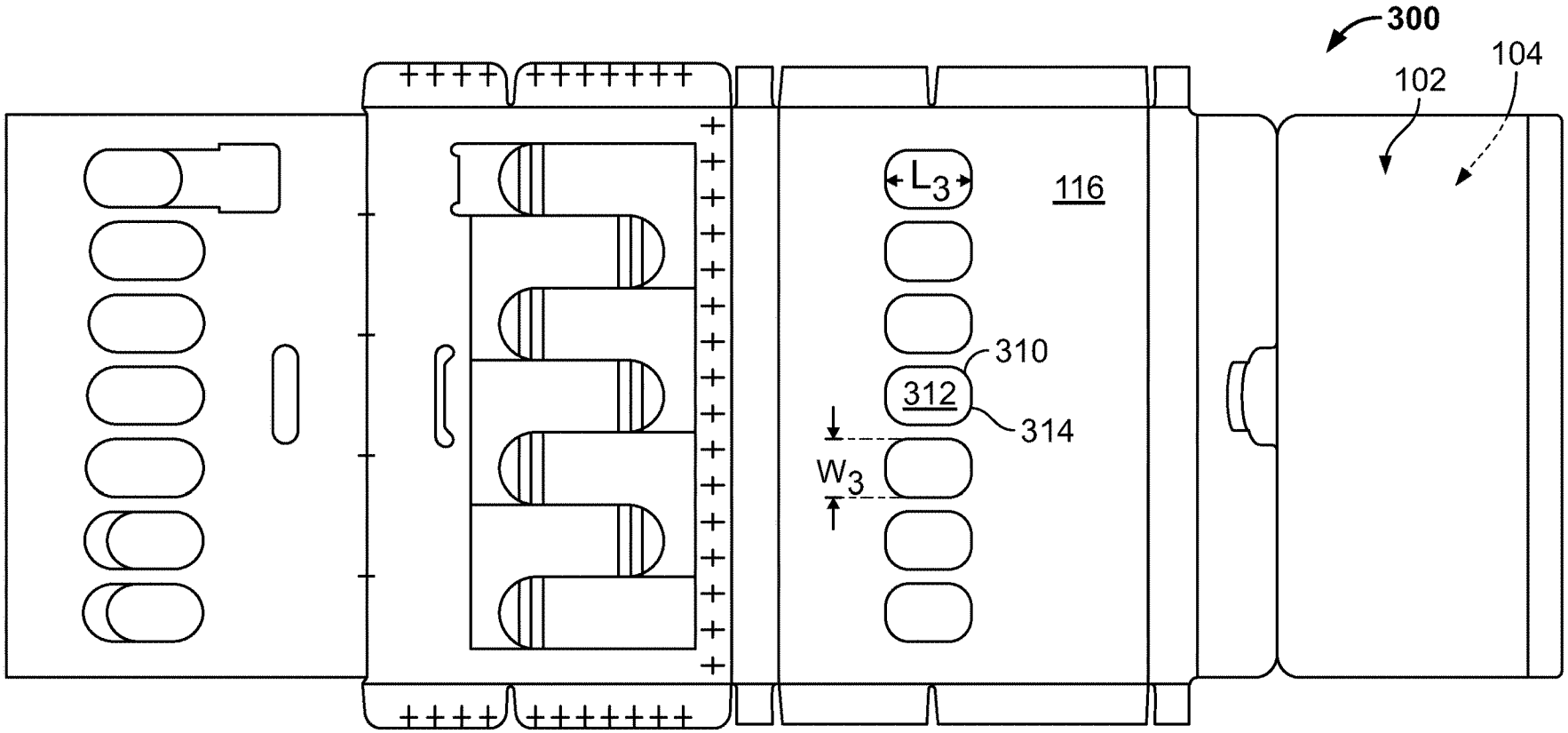
Figure 15B:
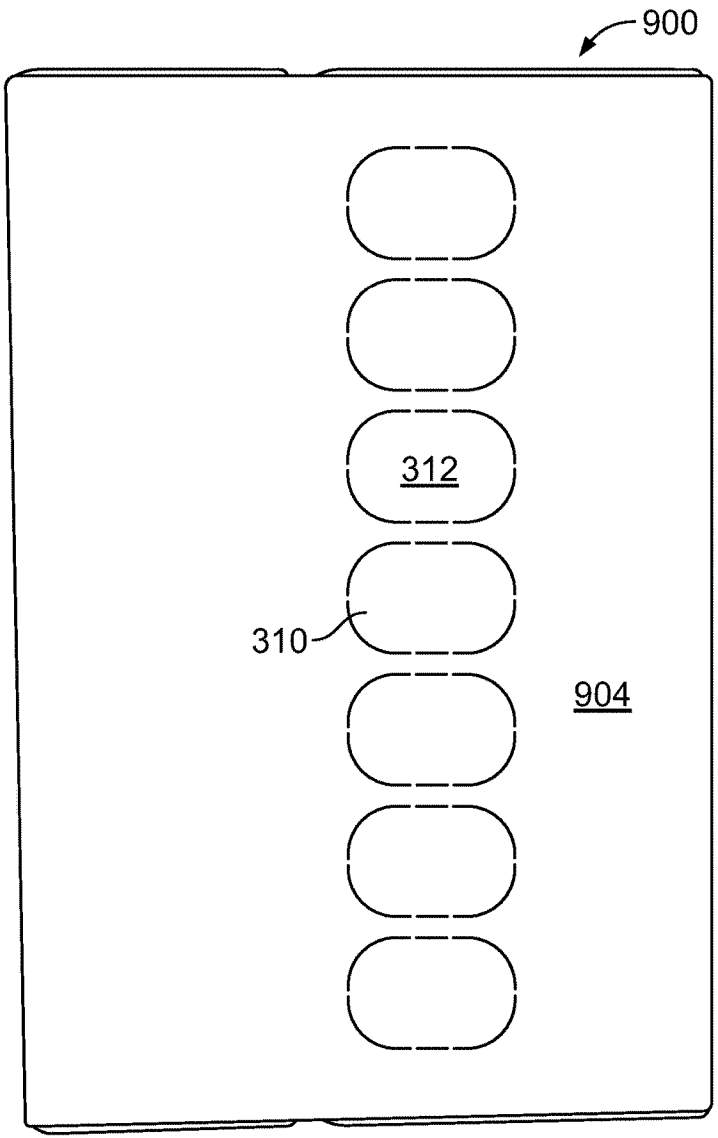
Figure 15A:
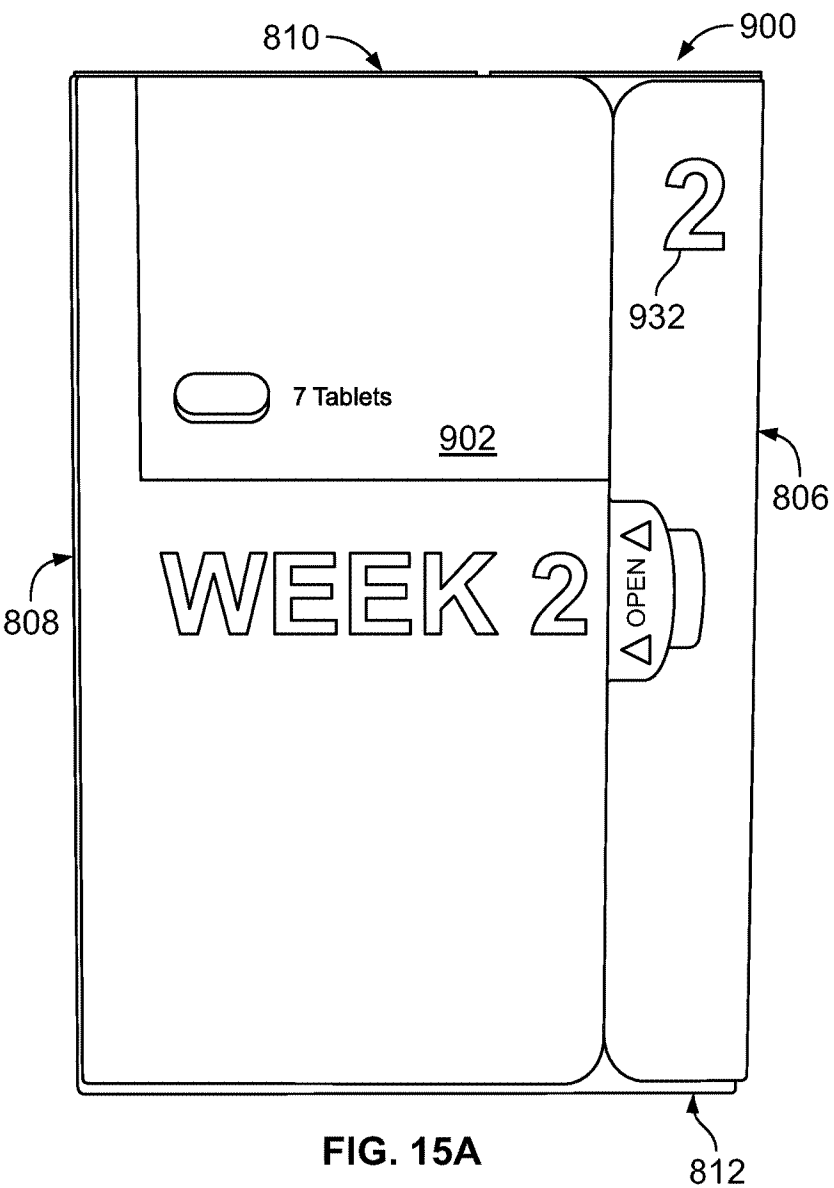
FIG. 15A is a top view of a second example embodiment of a medication booklet for use with the medication packaging and dispensing system shown in FIGS. 24-29.

FIG. 2 is a top plan view of a second example embodiment of a blank 300 for forming a medication booklet 900 (shown in FIGS. 15A and 15B). Elements of blank 300 shown in FIG. 2 that are substantially identical to elements of blank 100 shown in FIG. 1 are shown using the same numeric character references.

In the example embodiment of medication packaging and dispensing system 2000 (e.g., as shown in FIG. 24-29), blank 300 forms booklet 900, which contains a second set of medication doses. For example, booklet 900 contains medication doses prescribed to be taken during a second week of treatment. The doses in the second week of treatment ("second-week doses"), in the example embodiment, are a larger dose than the doses in the first week of treatment ("first-week doses"). The second-week doses may thus be larger (e.g., a larger pill or capsule) than the first-week doses. In some embodiments, the first-week doses include two pills or capsules, and the second-week doses include one pill or capsule containing a larger dose than the two first-week pills combined. Accordingly, back cutouts 310 included in back panel 116 of blank 300 may have a width $W_3$ that is slightly greater than width $W_2$ of back cutouts 210 of blank 100, to accommodate a larger pill or capsule that is dispensed through back cutouts 310. Back cutouts 310 also have length $L_3$ that is slightly less than length $L_2$ of back cutouts 210 of blank 100. A single medication blister module containing the single second-week pill requires less length than two spaced-apart blister modules (e.g., medication blister modules 708, shown in FIG. 7) for the two smaller pills of the first-week doses. It should be understood that back cutouts 310 may have any length $L_3$ (e.g., greater than or equal to $L_2$) and/or width $W_3$ (e.g., less than or equal to $W_2$), to accommodate a medication dose of any particular size or shape.

In addition, in the illustrated embodiment, back cutouts 310 in blank 300 include punch-out tabs 312 coupled to each back cutout 310 along a perforation line 314 defined along a perimeter of back cutout 310. These punch-out tabs 312 improve the child resistance of booklet 800 formed from blank 300, providing an additional barrier to medication blister modules 708 contained in booklet 900. It should be understood that blank 100, in certain embodiments, may also include punch-out tabs. Additionally or alternatively, blank 300 may include fewer or no punch-out tabs 312 in back cutouts 310. Punch-outs tabs 312 are de-coupled from back cutouts 310 upon exertion of a force on interior surface 102 thereof.

Figure 3:
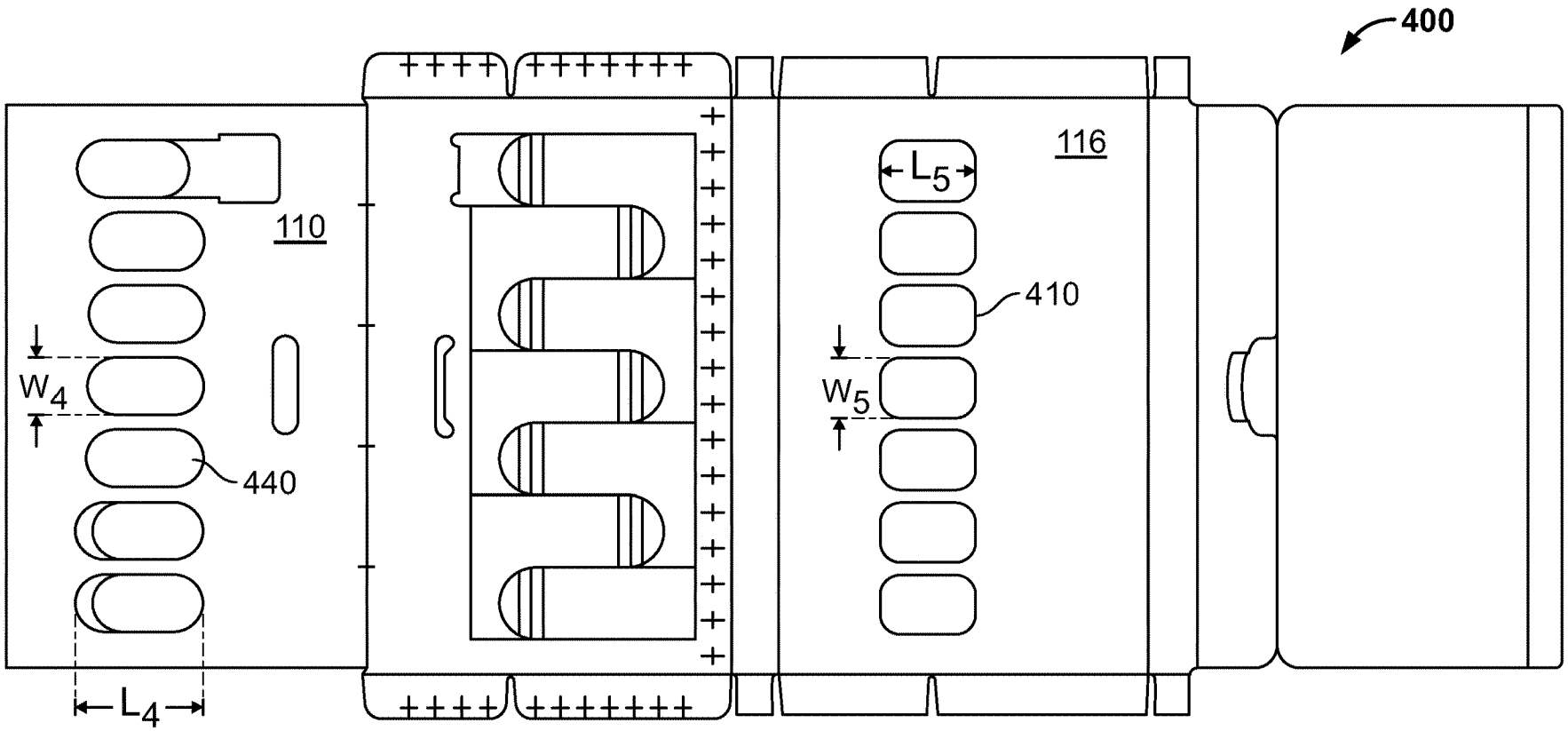
Figure 16B:
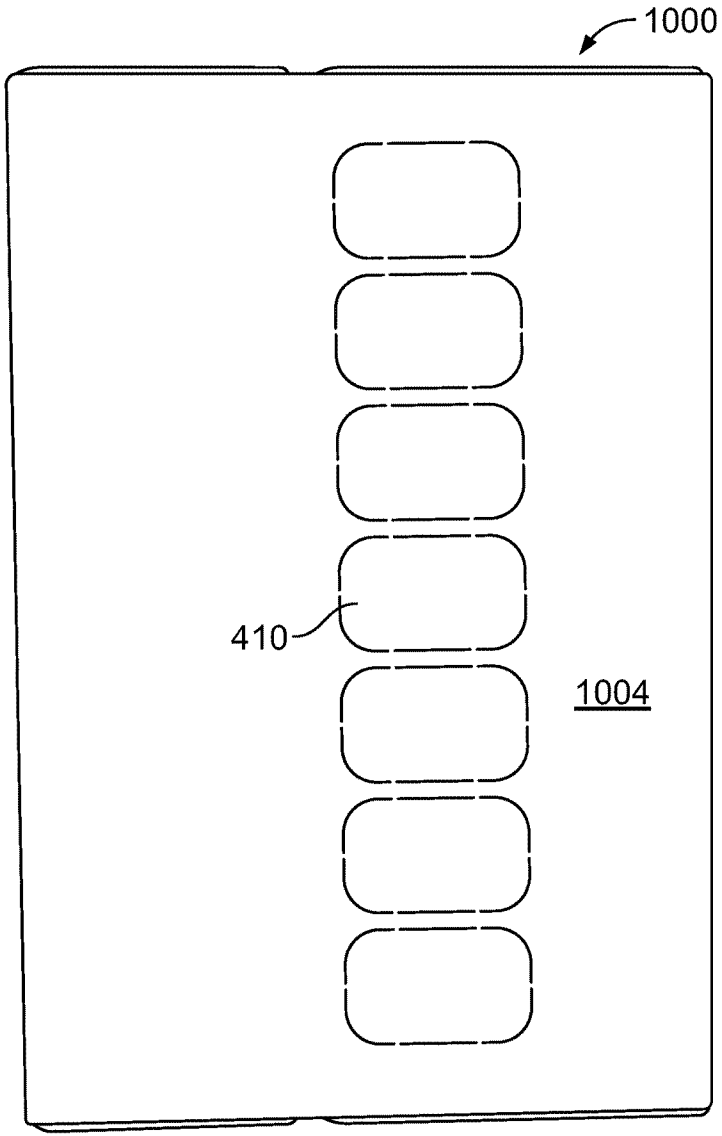
Figure 16A:
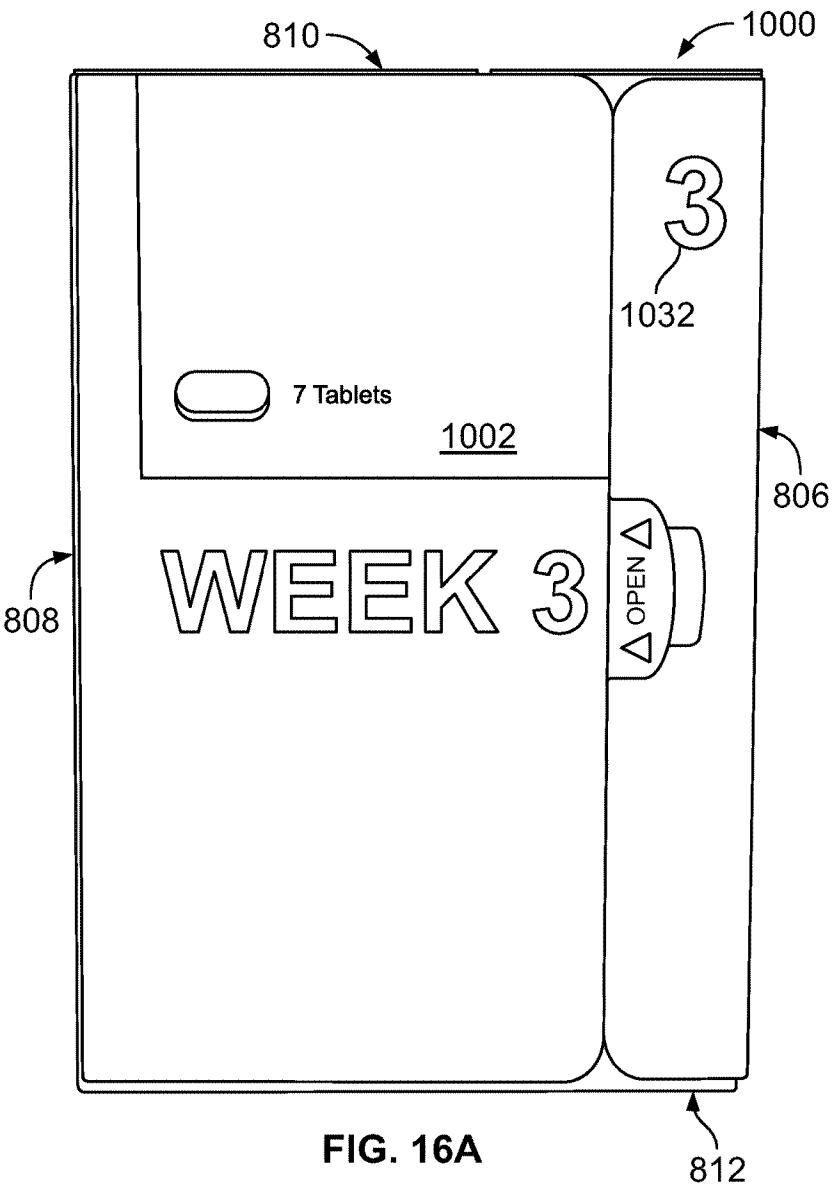
FIG. 16A is a top view of a third example embodiment of a medication booklet for use with the medication packaging and dispensing system shown in FIGS. 24-29.

FIG. 3 is a top plan view of a third example embodiment of a blank 400 for forming a medication booklet 1000 (shown in FIGS. 16A and 16B). Elements of blank 400 shown in FIG. 3 that are substantially identical to elements of blank 100 shown in FIG. 1 and/or blank 300 shown in FIG. 2 are shown using the same numeric character references.

In the example embodiment of medication packaging and dispensing system 2000 (e.g., as shown in FIGS. 24-29), blank 400 forms booklet 1000, which contains a third set of medication doses. For example, booklet 1000 contains medication doses prescribed to be taken during a third week of treatment. The doses in the third week of treatment ("third-week doses"), in the example embodiment, are a larger dose than the second-week doses. The third-week doses may thus be larger (e.g., a larger pill or capsule) than the second-week doses. Accordingly, front cutouts 440 included in inner front panel 110 of blank 400 have a width $W_4$ that is slightly greater than width $W_1$ of front cutouts 140 of blank 100, to accommodate access to a larger pill in medication blister modules of the blister card contained in booklet 1000. Additionally, a length $L_4$ of front cutouts 440 is greater than length $L_1$ of front cutouts 140 of blank 100. Moreover, back cutouts 410 included in back panel 116 of blank 400 are larger than back cutouts 210 and 310, to accommodate a larger pill being dispensed through back cutouts 410 than through back cutouts 210 or back cutouts 310. Back cutouts 410 have a length $L_5$ and a width $W_5$, wherein length $L_5$ is greater than length $L_3$ and length $L_2$ of back cutouts 210 and 310, respectively, and width $W_5$ is greater than widths $W_3$ and $W_2$ of back cutouts 210 and 310, respectively. In various other embodiments, front cutouts 440 and/or back cutouts 410 may have alternative dimensions to accommodate alternative sizes, shapes, and/or configurations of medication in booklet 1000.

Figure 4:
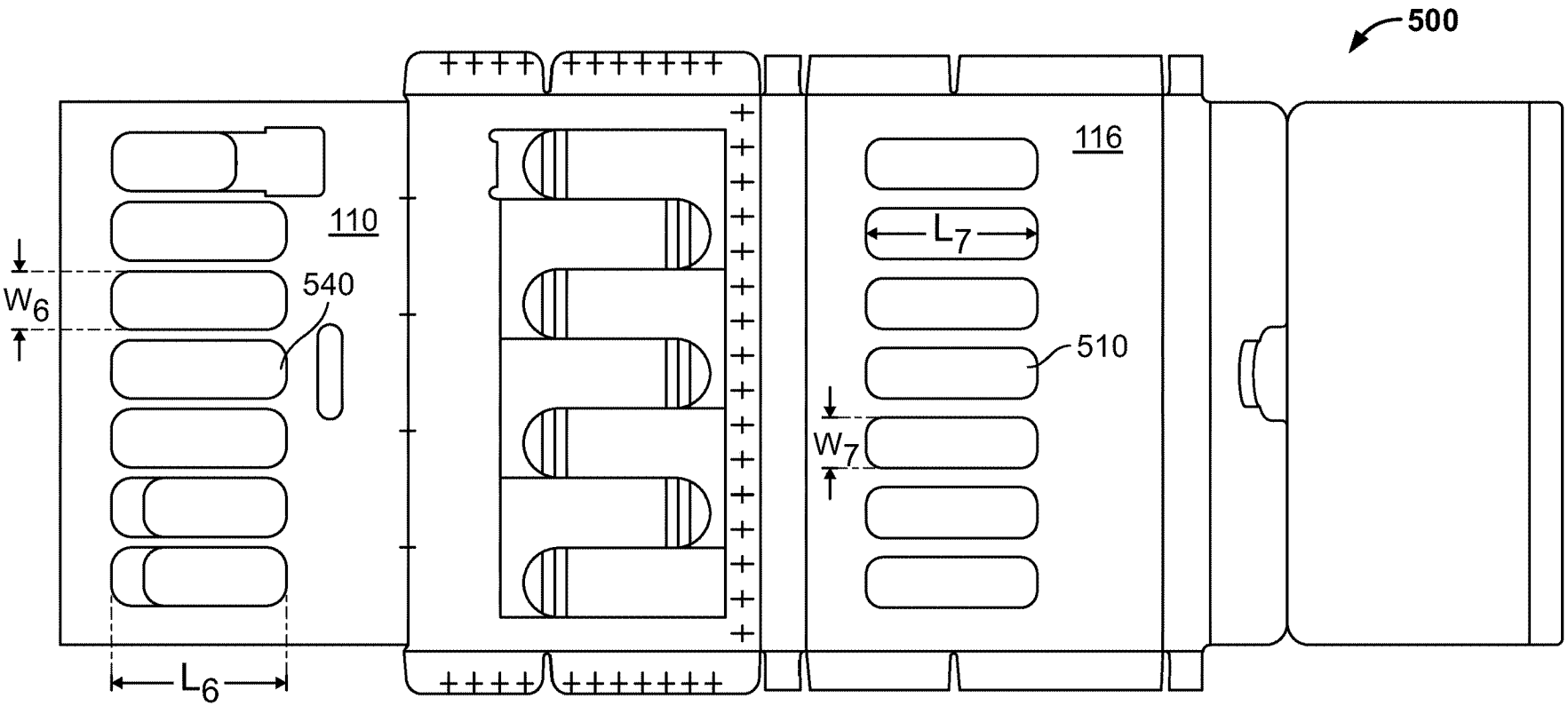
Figure 17B:
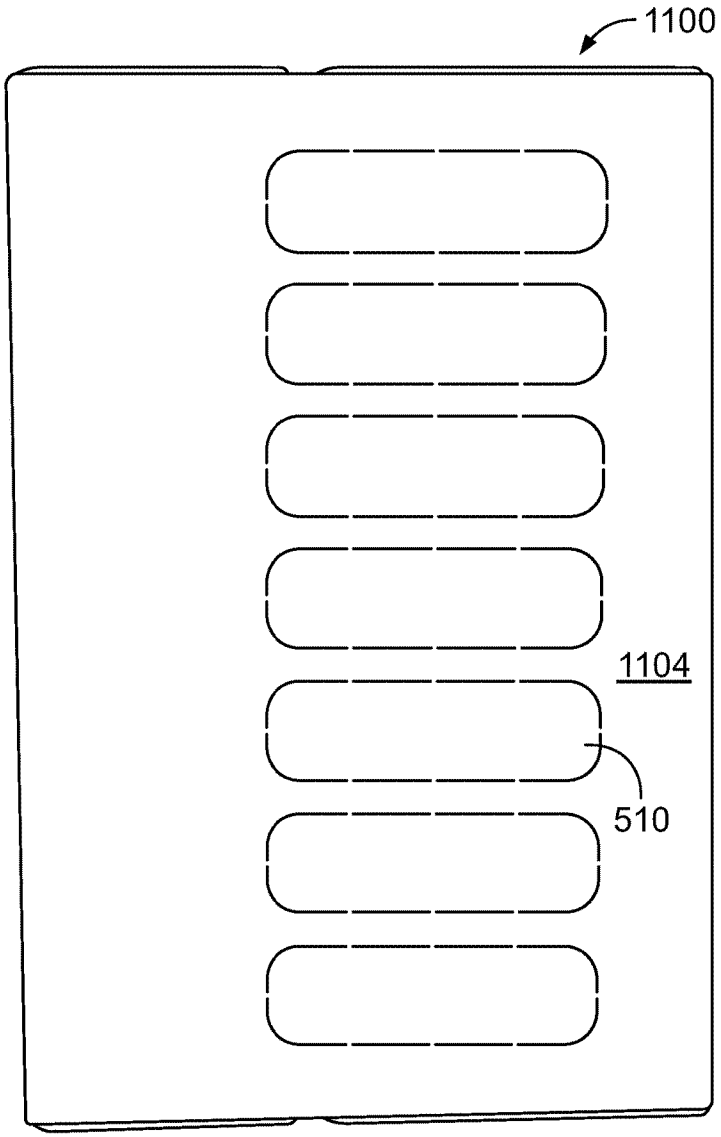
Figure 17A:
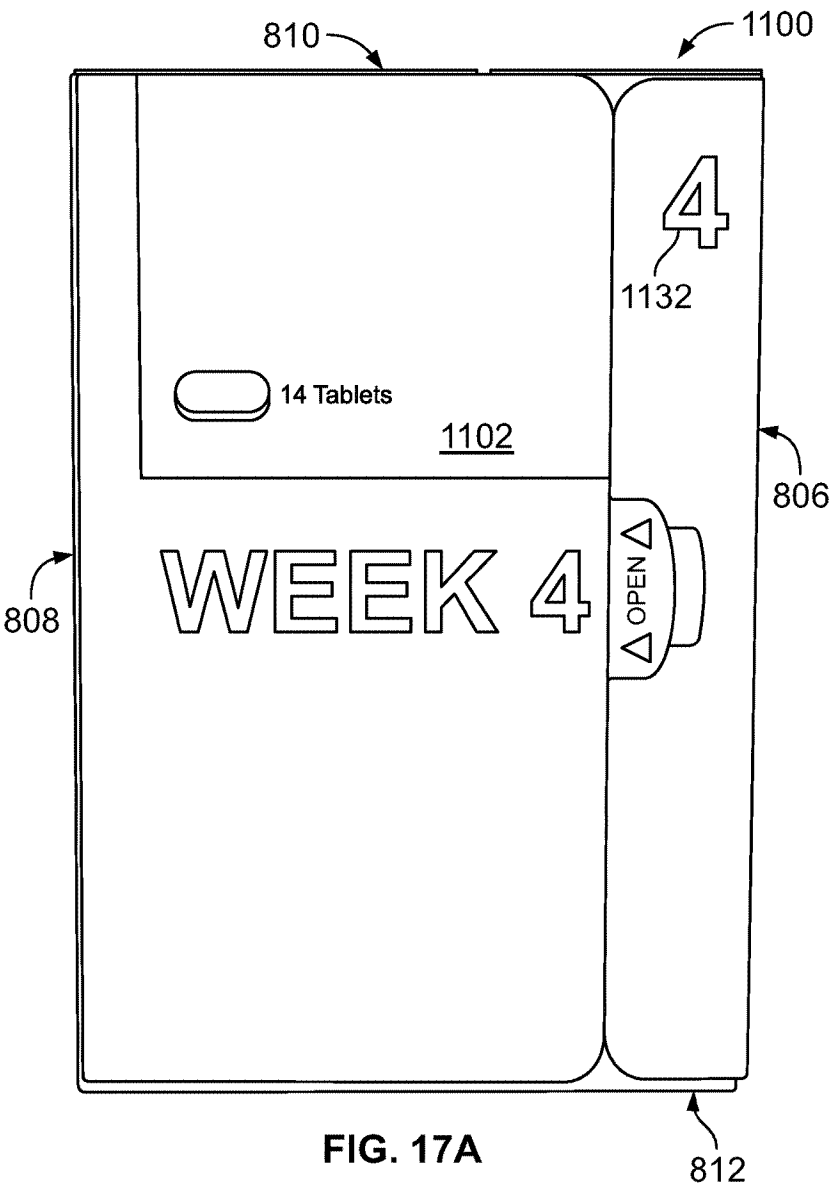
FIG. 17A is a top view of a fourth example embodiment of a medication booklet for use with the medication packaging and dispensing system shown in FIGS. 24-29.

FIG. 4 is a top plan view of a fourth example embodiment of a blank 500 for forming a medication booklet 1100 (shown in FIGS. 17A and 17B). Elements of blank 500 shown in FIG. 4 that are substantially identical to elements of any of blanks 100, 300, and/or 400 shown in FIGS. 1-3 are shown using the same numeric character references.

In the example embodiment of medication packaging and dispensing system 2000 (e.g., as shown in FIGS. 24-29), blank 500 forms booklet 1100, which contains a fourth set of medication doses. For example, booklet 1100 contains medication doses prescribed to be taken during a fourth week of treatment. The doses in the fourth week of treatment ("fourth-week doses"), in the example embodiment, are a larger dose than the third-week doses. In one embodiment, the fourth-week doses are twice as much as the third-week doses, and the blister card includes two third-week doses as a single fourth-week dose. Accordingly, front cutouts 540 included in inner front panel 110 of blank 500 have a width $W_6$ that is substantially equal to width $W_4$ of front cutouts 440 of blank 400, but have a length $L_6$ that is greater than length $L_4$ of front cutouts 440 of blank 400, to accommodate two pills. Moreover, back cutouts 510 included in back panel 116 of blank 500 are larger than back cutouts 410 of blank 400, to accommodate two pills being dispensed through back cutouts 510. Back cutouts 510 have a length $L_7$ and a width $W_7$, wherein length $L_7$ is greater than length $L_5$ of back cutouts 410, and width $W_7$ is greater than width $W_5$ of back cutouts 410. In various other embodiments, front cutouts 540 and/or back cutouts 510 may have alternative dimensions to accommodate alternative sizes, shapes, and/or configurations of medication in booklet 1100.

Figure 5:
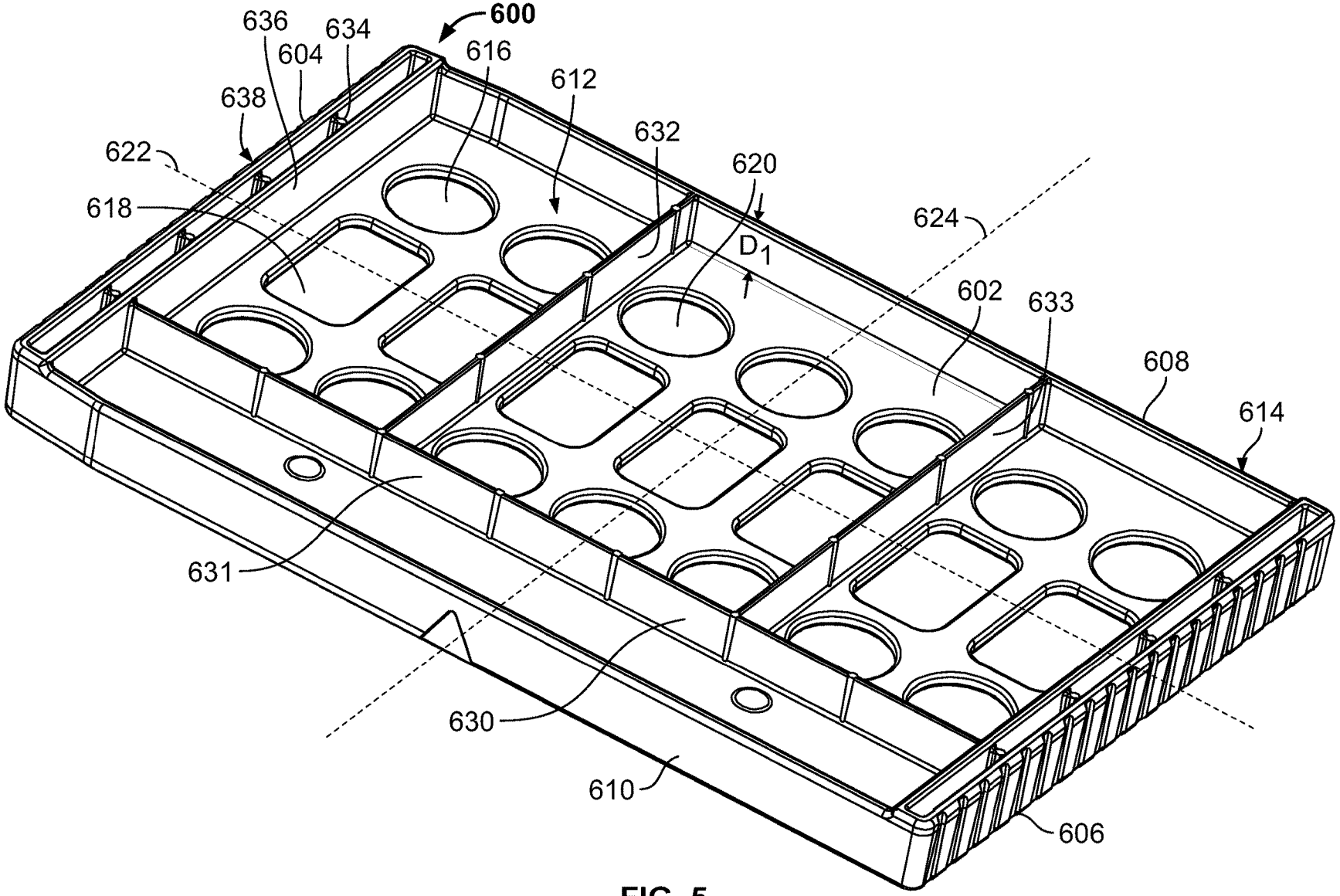
Figure 6:
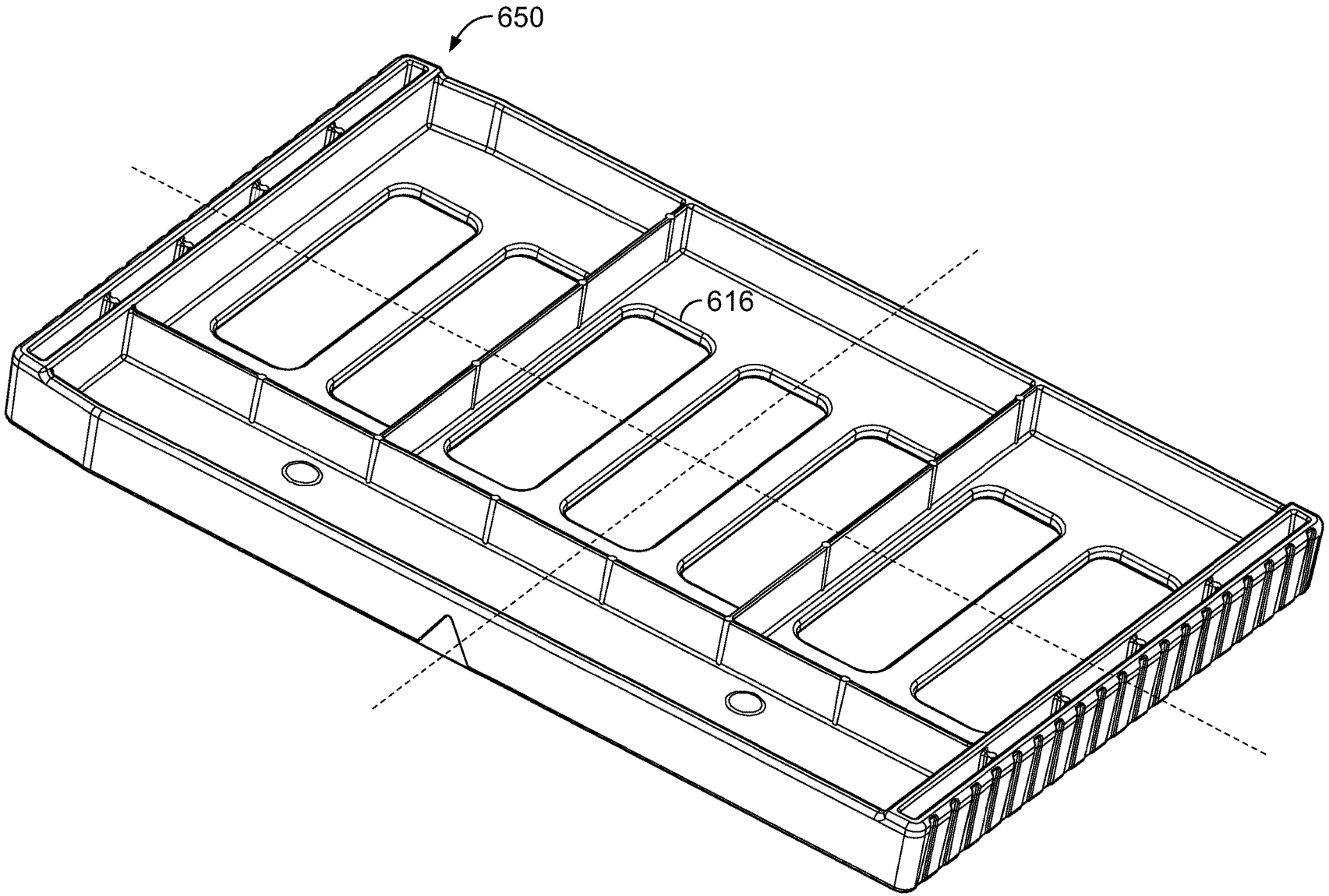
Figure 7:
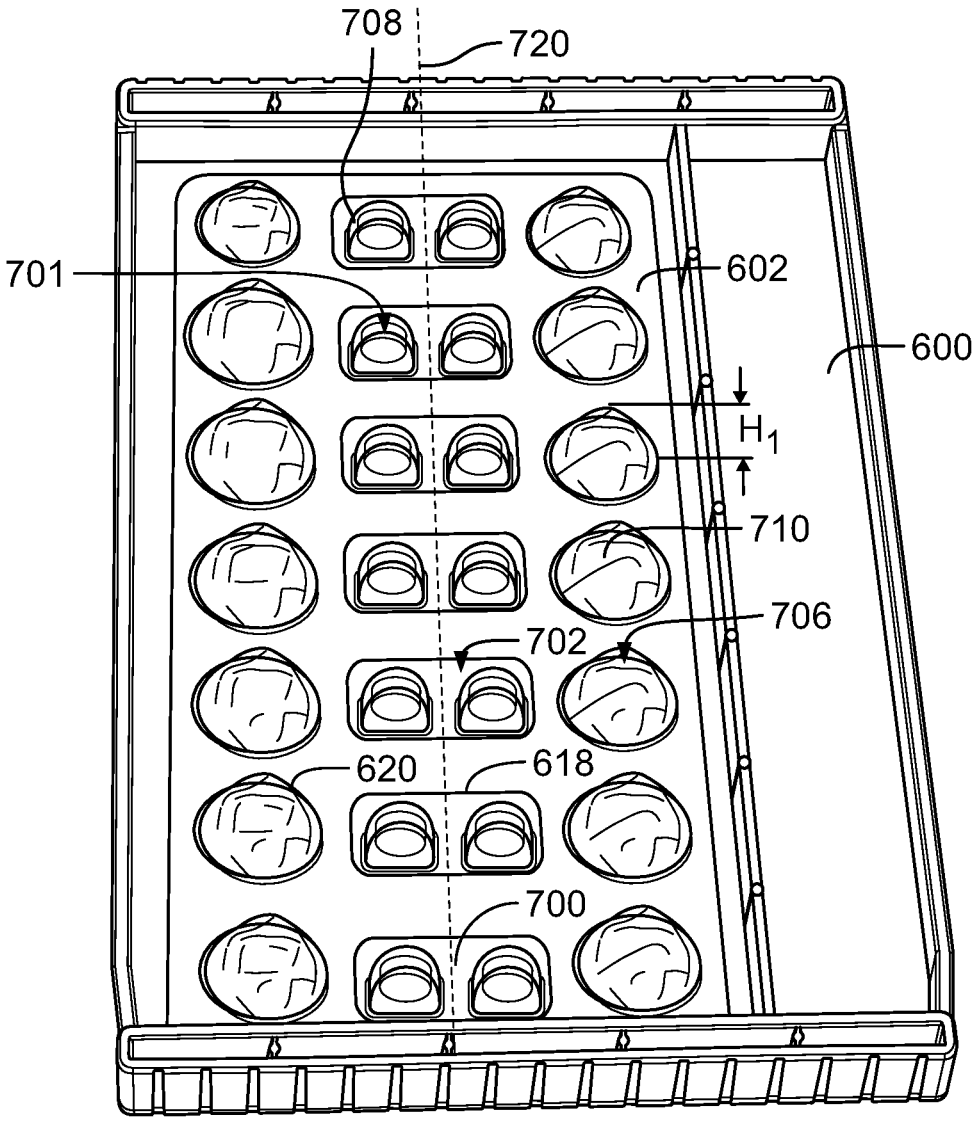
Figure 8:
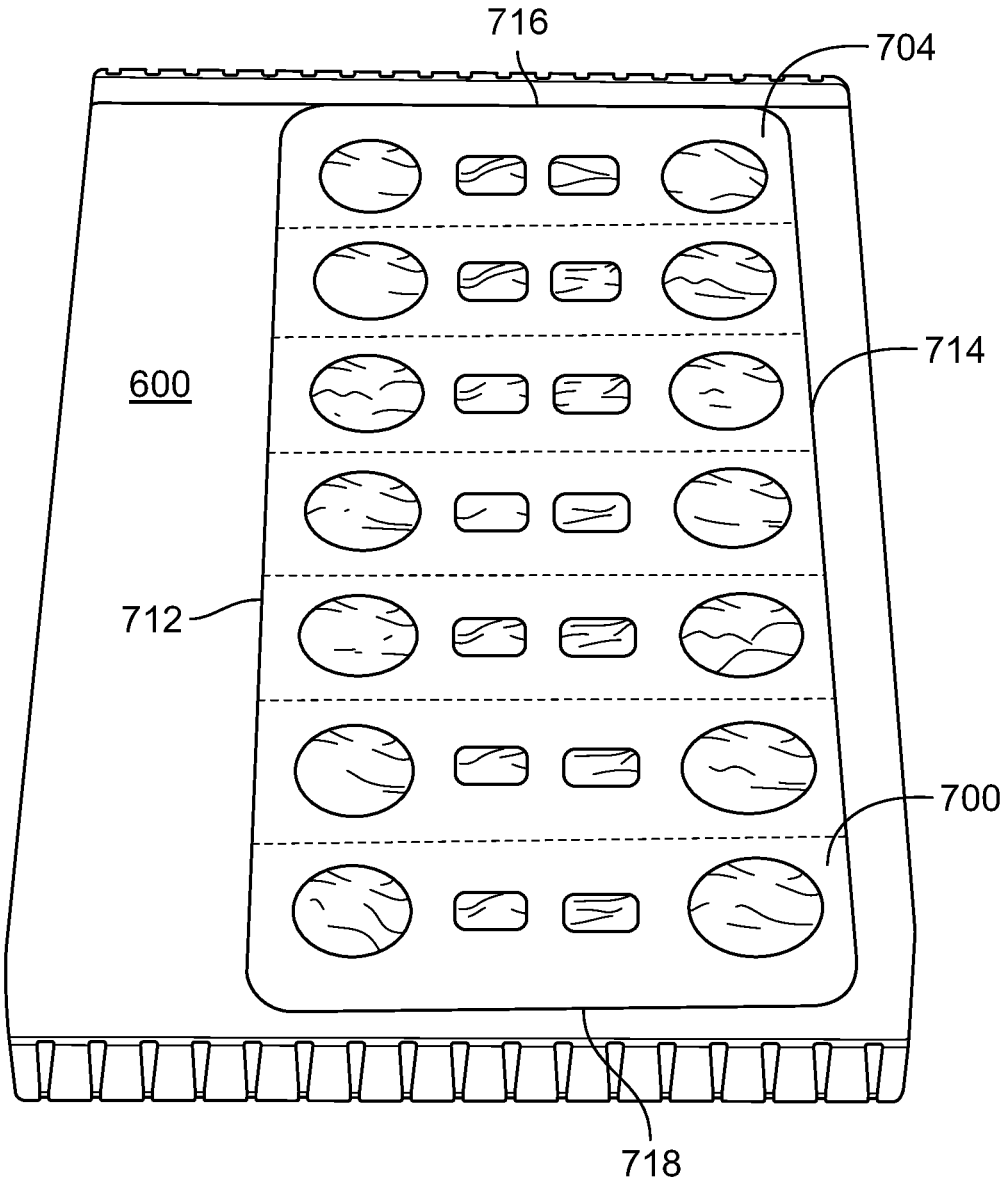

With reference to FIGS. 5-8, pucks and blister cards are shown, configured for use with medication booklets 800, 900, 1000, and/or 1100 shown in FIGS. 11-17B. More specifically, FIG. 5 is a perspective view of a first example embodiment of a puck 600, FIG. 6 is a perspective view of a second example embodiment of a puck 650, FIG. 7 is a perspective view of a first surface 702 of an example embodiment of a medication blister card 700 that is adhered to puck 600, and FIG. 8 is a perspective view of a second surface 704 of medication blister card 700 shown in FIG. 7 adhered to puck 600. Puck 600, 650 acts a rigid support for medication booklets 800, 900, 1000, and/or 1100, preventing bending or crushing thereof, as well as a housing for medication blister card 700. Medication blister card 700 contains medication 701 therein, in medication blister modules 708. As described further herein, medication blister card 700 is adhered or otherwise secured to puck 600, which secures medication blister card 700 in an appropriate orientation in medication booklets 800, 900, 1000, and/or 1100 such that medication 701 may dispensed therefrom. In one embodiment, puck 600, 650 is fabricated from a rigid plastic material, such as polypropylene. Puck 600, 650, however, may be fabricated using any suitable material known to those skilled in the art and guided by the teachings herein provided, and therefore is not limited to a specific type of material. In one embodiment, first surface 702 of medication blister card 700 is fabricated from a semi-rigid or flexible plastic material. For example, first surface 702 may be fabricated from TekniPlex® VPA 7400, including 0.0075" PVC, 0.002" PE, and 0.004" PCTFE (TekniPlex is a registered trademark of Tekni-Plex, Inc., King of Prussia, Pa.). First surface 702 of medication blister card 700 includes a plurality of wells or modules 706 defined therein. Second surface 704 of medication blister card 700 may be fabricated from a foil material that is coupled against first surface 702, to seal modules 706. For example, second surface 704 may be fabricated from Amcor® 13037, which includes 25 micron aluminum foil backed with 15 pound per ream, machine-glazed, bleached kraft paper and 4506 HSC (Amcor is registered trademark of Amcor Limited, Abbotsford, Victoria, Australia). Medication blister card 700 may be fabricated using any suitable material known to those skilled in the art and guided by the teachings herein provided, and therefore is not limited to specific types of material.

Referring to FIG. 5, in the illustrated embodiment, puck 600 includes a back wall 602 and a plurality of side walls extending in a substantially perpendicular relationship therefrom. The plurality of side walls includes a first side wall 604, a second side wall 606, a third side wall 608, and a fourth side wall 610. Side walls 604, 606, 608, 610 define a cavity 612 having a depth $D_1$ corresponding to a height of side walls 604, 606, 608, 610. In the illustrated embodiment, depth $D_1$ of cavity 612 is substantially equal to or slightly greater than a height $H_1$ (shown in FIG. 7) of blister modules 706, such that medication blister modules 708 are recessed in cavity 612 of puck 600, relative to a top edge 614 of side walls 604, 606, 608, 610 of puck 600. As children may be able to access contents of blister modules by tearing open those modules at the first (plastic) surface of a blister card, recessing medication blister modules 708 improves the child resistance of medication booklets 800, 900, 1000, and/or 1100 by substantially preventing access to an interior of medication blister modules 708 (e.g., access to medication 701) from first (plastic) surface 702.

Referring to FIGS. 7 and 8, medication blister card 700 includes a first side edge 712, a second, opposing side edge 714, a first end edge 716, and a second, opposing end edge 718. Medication blister card 700 has a generally rectangular shape, although in other embodiments, medication blister card 700 may have any suitable shape that enables medication blister card 700 to function as described herein. Back wall 602 of puck 600 also has a generally rectangular shape, corresponding both to a shape of medication blister card 700 and to a shape of medication booklets 800, 900, 1000, and/or 1100. In other embodiments, back wall 602 and/or puck 600 may have any suitable shape that enables puck 600 and/or medication booklets 800, 900, 1000, and/or 1100 to function as described herein. First surface 702 of medication blister card 700 is adhered or otherwise coupled to an exterior surface of back wall 602 of puck 600. In the example embodiment, medication blister card 700 is adhered to back wall 602 of puck 600 with adhesive disposed along substantially an entire length of first side edge 712 and second side edge 714. Accordingly, medication blister card 700 is well secured to back wall 602 of puck 600, which improves the child resistance of system 2000 (shown in FIGS. 24-29) by preventing tampering of medication blister card 700 and/or removal of medication blister card 700 from puck 600. In one embodiment, medication blister card 700 is adhered to puck 600 using a high-tack hot-melt adhesive. It should be understood that medication blister card 700 may be otherwise coupled to puck 600 (e.g., coupled to an interior surface of back wall 602).

Back wall 602 of puck 600 includes a plurality of cutouts 616 defined therein. More specifically, in the illustrated embodiment, back wall 602 includes a plurality of primary cutouts 618 and a plurality of secondary cutouts 620. Referring to FIG. 7, primary cutouts 618 are configured to receive medication blister modules 708 therein. In the illustrated embodiment, primary cutouts 618 have a generally rectangular or rounded rectangular shape. However, in alternative embodiments, primary cutouts 618 may have any suitable shape that enables primary cutouts 618 to receive medication blister modules 708 therein. Medication blister modules 708 are aligned with respect to a longitudinal axis 720 of blister card 700. Similarly, primary cutouts 618 are aligned with adjacent primary cutouts 618 parallel to a longitudinal axis 622 of puck 600. In the illustrated embodiment, medication blister card 700 is configured to hold seven doses, or one week's worth of the medication doses. Moreover, each daily dose includes two pills 701. Accordingly, there are two discrete medication blister modules 708 for each daily dose, such that there are fourteen medication blister modules 708 included in blister card 700. In other embodiments of blister card 700, for example in blister cards for subsequent weeks of the medication, each daily dose may only include one pill 701, such that there are seven medication blister modules 708 included in blister card 700. In various embodiments, there may be additional, fewer, or differently configured medication blister modules 708 on blister card 700, corresponding to the treatment regimen of medication 701 contained in blister card 700.

Secondary cutouts 620 are aligned with adjacent secondary cutouts 620 parallel to longitudinal axis 622 of puck 600, and with adjacent primary cutouts 618 parallel to a latitudinal axis 624 of puck 600. Secondary cutouts 620 are configured to receive empty blister modules 710 of blister card 700. In the illustrated embodiments, secondary cutouts 620 have a generally circular shape, corresponding to a shape of empty blister modules 710. In alternative embodiments, secondary cutouts 620 may have any suitable shape that enables secondary cutouts 620 to receive empty blister modules 710 therein. Additionally, in the illustrated embodiment, primary cutouts 618 and secondary cutouts 620 are separate and discrete cutouts. In one alternative embodiment, a single cutout 616 serves as both a primary and secondary cutout, sized to receive a medication blister module 708 and an empty blister module 710 therein. In another alternative embodiment, a single primary cutout 618 may be sized receive two longitudinally adjacent medication blister modules 708 therein, and/or a single secondary cutout 620 may be sized to receive to longitudinally adjacent empty blister modules 710 therein. In other words, the particular size and configuration of cutouts 616 illustrated in FIG. 5 is a non-limiting example of many possible sizes and configurations thereof.

Puck 600 further includes a plurality of primary support ribs 630 extending from back wall 602 in a substantially perpendicular relationship thereto. In the illustrated embodiment, a first primary support rib 631 extends longitudinally across puck 600 from first side wall 604 to opposing second side wall 606, and second and third primary support ribs 632, 633 extend latitudinally from third side wall 608 of puck 600 to first primary support rib 631. Support ribs 630 are configured to add rigidity and structural stability to puck 600 and, therefore, to medication booklet 800, 900, 1000, and/or 1100 containing puck 600. In the illustrated embodiment, first and second side walls 604, 606 are reinforced side walls. Each reinforced side wall 604, 606 includes secondary support ribs 634 extending between an interior face 636 and an exterior face 638 of the respective reinforced side wall 604, 606, further increasing the structural stability of puck 600 to prevent bending or crushing thereof.

Referring to second example embodiment puck 650, elements of puck 650 shown in FIG. 6 that are substantially identical to elements of puck 600 shown in FIG. 5 are shown using the same numeric character references. In the illustrated embodiment, puck 650 includes a plurality of cutouts 616, without discrete primary and secondary cutouts. Puck 650 may be suitable for use with fourth-week medication booklet 1100 (shown in FIGS. 17A and 17B). In one embodiment, a blister card containing the fourth-week doses does not include empty blister modules 710, as the medication blister modules are sized to accommodate two third-week pills or capsules, which are larger relative to the size of the first- or second-week doses. Accordingly, puck 650 includes only cutouts 616 sized to accommodate the medication blister modules for the fourth-week doses. In some embodiments, puck 650 may be used for any of the first-, second-, and/or third-week blister cards, wherein cutouts 616 are sized to receive a medication blister module 708 and two latitudinally adjacent empty blister modules 710 therein.

Figure 9:
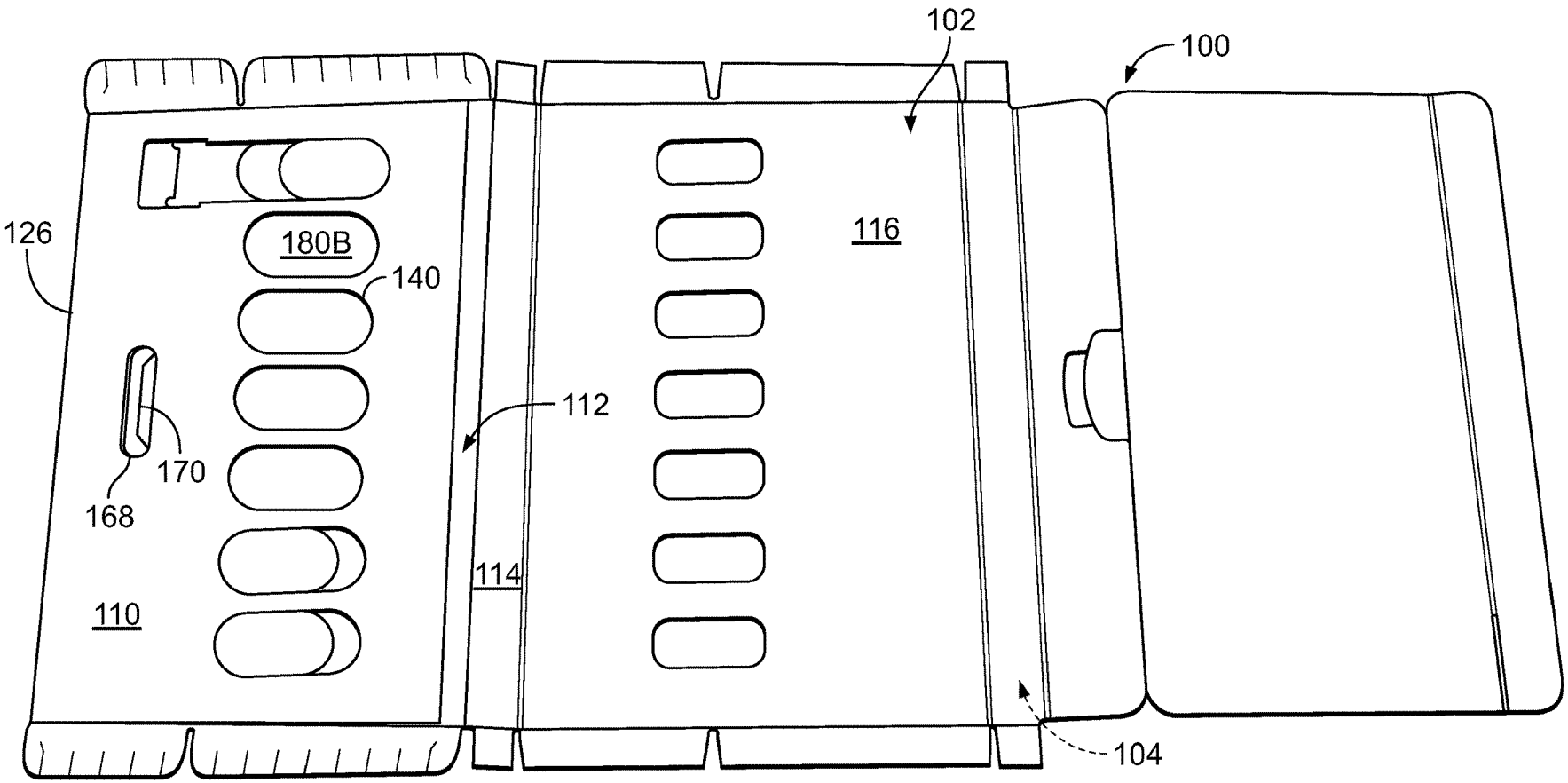
Figure 10A:
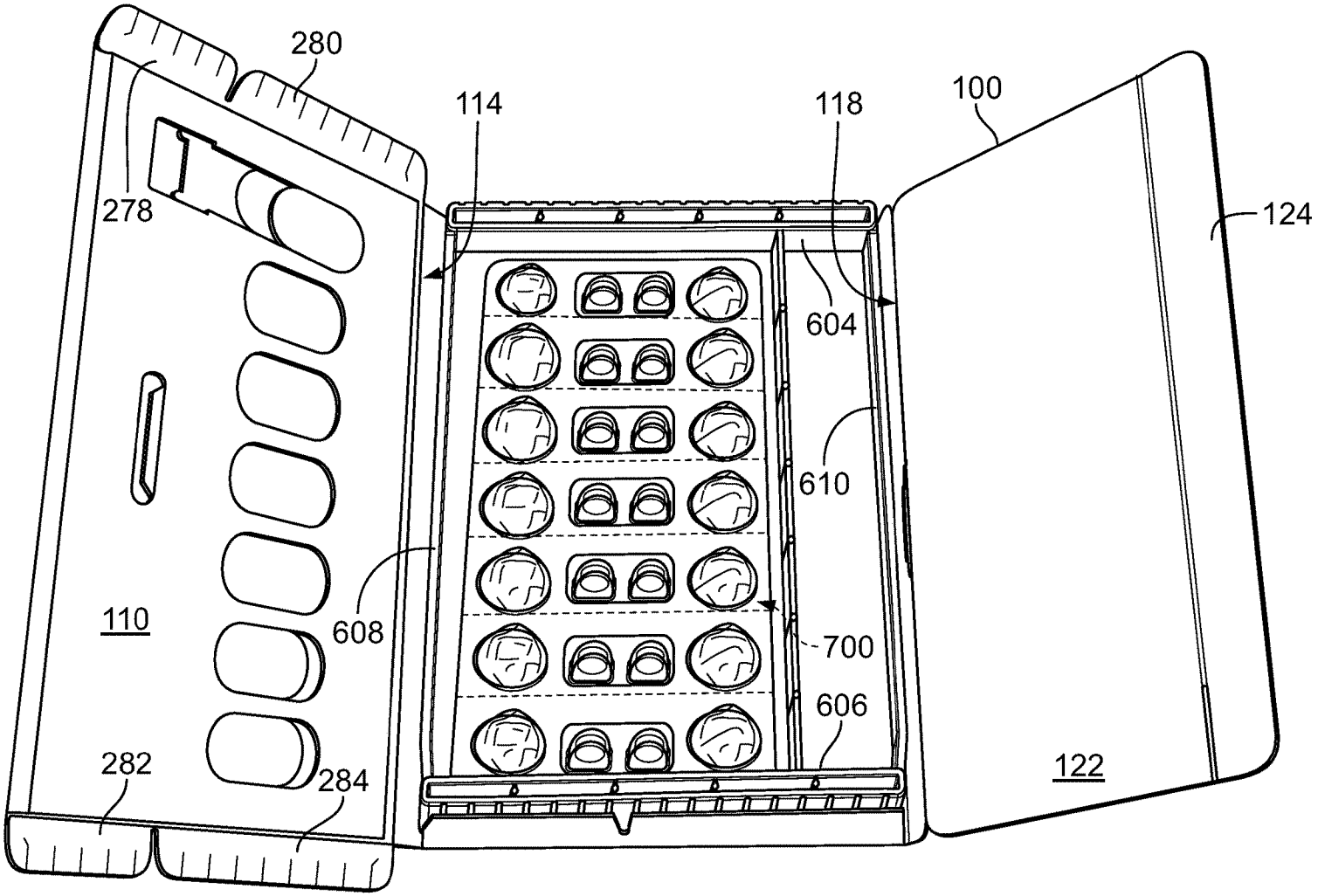

FIGS. 9 and 10A illustrate formation of a first embodiment of a medication booklet 800 (shown in FIGS. 11-14) using blank 100 of FIG. 1, and puck 600 and blister card 700 of FIGS. 5, 7, and 8. With reference to FIG. 9, inner front panel 110 is rotated about fold line 126 to couple against outer front panel 112. In the illustrated embodiment, interior surface 102 of inner front panel 110 is secured to interior surface 102 of outer front panel 112. Front cutouts 140 of inner front panel 110 are substantially aligned with pull tabs 180 of outer front panel 112, and inner locking slot 168 is substantially aligned with outer locking slot 170.

Puck 600 with blister card 700 adhered thereto is positioned against interior surface 102 of back panel 116 of blank 100. In some embodiments, puck 600 and/or blister card 700 may be adhered to back panel 116 of blank 100. Turning to FIG. 10A, in the illustrated embodiment, first side panel 114 is rotated about fold line 130 into a substantially perpendicular relationship with back panel 116, such that interior surface 102 of first side panel 114 is engaged in a face-to-face relationship with third side wall 608 of puck 600. Similarly, second side panel 118 is rotated about fold line 134 into a substantially perpendicular relationship with back panel 116, such that interior surface 102 of second side panel 118 is engaged in a face-to-face relationship with fourth side wall 610 of puck 600. First end flap 250 is rotated about a fold line at first end edge 260 of first side panel 114 into a substantially perpendicular relationship with first side panel 114, such that interior surface 102 of first end flap 250 is engaged in a face-to-face relationship with first side wall 604 of puck 600. In the illustrated embodiment, first end flap 250 is adhered or otherwise secured to first side wall 604 of puck 600. Second end flap 252 is rotated about a fold line at second end edge 262 of first side panel 114 into a substantially perpendicular relationship with first side panel 114, such that interior surface 102 of second end flap 252 is engaged in a face-to-face relationship with second side wall 606 of puck 600. In the illustrated embodiment, second end flap 252 is adhered or otherwise secured to second side wall 606 of puck 600. Third end flap 254 is rotated about a fold line at first end edge 264 of second side panel 118 into a substantially perpendicular relationship with second side panel 118, such that interior surface 102 of third end flap 254 is engaged in a face-to-face relationship with first side wall 604 of puck 600. In the illustrated embodiment, third end flap 254 is adhered or otherwise secured to first side wall 604 of puck 600. Fourth end flap 256 is rotated about a fold line at second end edge 266 of second side panel 118 into a substantially perpendicular relationship with second side panel 118, such that interior surface 102 of fourth end flap 256 is engaged in a face-to-face relationship with second side wall 606 of puck 600. In the illustrated embodiment, fourth end flap 256 is adhered or otherwise secured to second side wall 606 of puck 600.

First inner major end panel 272 and first inner minor end panel 270 are rotated about a fold line at first end edge 286 of back panel 116 into a substantially perpendicular relationship with back panel 116. First inner major end panel 272 engages in a face-to-face relationship with first side wall 604 of puck 600 and exterior surface 104 of third end flap 254. In the illustrated embodiment, first inner major end panel 272 is adhered or otherwise secured to at least one of first side wall 604 of puck 600 and third end flap 254. First inner minor end panel 270 engages in a face-to-face relationship with first side wall 604 of puck 600 and exterior surface 104 of first end flap 250. In the illustrated embodiment, first inner minor end panel 270 is adhered or otherwise secured to at least one of first side wall 604 of puck 600 and first end flap 250. second inner major end panel 276 and second inner minor end panel 274 are rotated about a fold line at second end edge 288 of back panel 116 into a substantially perpendicular relationship with back panel 116. Second inner major end panel 276 engages in a face-to-face relationship with second side wall 606 of puck 600 and exterior surface 104 of fourth end flap 256. In the illustrated embodiment, second inner major end panel 276 is adhered or otherwise secured to at least one of second side wall 606 of puck 600 and fourth end flap 256. Second inner minor end panel 274 engages in a face-to-face relationship with second side wall 606 of puck 600 and exterior surface 104 of second end flap 252. In the illustrated embodiment, second inner minor end panel 274 is adhered or otherwise secured to at least one of second side wall 606 of puck 600 and second end flap 252. Accordingly, puck 600 is secured in position against back panel 116 of blank 100.

Outer front panel 112 and inner front panel 110 (secured thereto) are rotated about fold line 128 into a substantially parallel relationship with back panel 116, thereby covering and enclosing puck 600 and blister card 700. First outer major end panel 280 and first outer minor end panel 278 are rotated about a fold line at first end edge 290 of outer front panel 112 into a substantially perpendicular relationship with outer front panel 112. First outer major end panel 280 engages in a face-to-face relationship with at least one of first inner major end panel 272 and first inner minor end panel 270. In the illustrated embodiment, interior surface 102 of first outer major end panel 280 is adhered or otherwise secured to exterior surface 104 of at least one of first inner major end panel 272 and first inner minor end panel 270. First outer minor end panel 278 engages in a face-to-face relationship with at least one of first inner major end panel 272 and first inner minor end panel 270. In the illustrated embodiment, interior surface 102 of first outer minor end panel 278 is adhered to exterior surface 104 of first inner major end panel 272.

Second outer major end panel 284 and second outer minor end panel 282 are rotated about a fold line at second end edge 292 of outer front panel 112 into a substantially perpendicular relationship with outer front panel 112. Second outer major end panel 284 engages in a face-to-face relationship with at least one of second inner major end panel 276 and second inner minor end panel 274. In the illustrated embodiment, interior surface 102 of second outer major end panel 284 is adhered or otherwise secured to exterior surface 104 of at least one of second inner major end panel 276 and second inner minor end panel 274. Second outer minor end panel 282 engages in a face-to-face relationship with at least one of second inner major end panel 276 and second inner minor end panel 274. In the illustrated embodiment, interior surface 102 of second outer minor end panel 282 is adhered to exterior surface 104 of second inner major end panel 276.

In one embodiment, adhesive is applied to interior surface 102 of front glue panel 120. Front glue panel 120 is rotated about fold line 134 into a face-to-face relationship with outer front panel 112. In the illustrated embodiment, front glue panel 120 is adhered or otherwise secured to exterior surface 104 of outer front panel 112. Medication booklet 800 defines a closed cavity (not specifically shown) therein.

Moreover, cover panel 122 is also engaged in a face-to-face relationship with outer front panel 112. More specifically, interior surface 102 of cover panel 122 is coupled against exterior surface 104 of outer front panel 112. In one embodiment, adhesive is applied to interior surface 102 of side glue panel 124. Side glue panel 124 is rotated about fold line 138 into a face-to-face relationship with first side panel 114. In the illustrated embodiment, side glue panel 124 is adhered or otherwise secured to exterior surface 104 of first side panel 114, to form medication booklet 800 as shown in FIGS. 11-14.

Figure 10B:
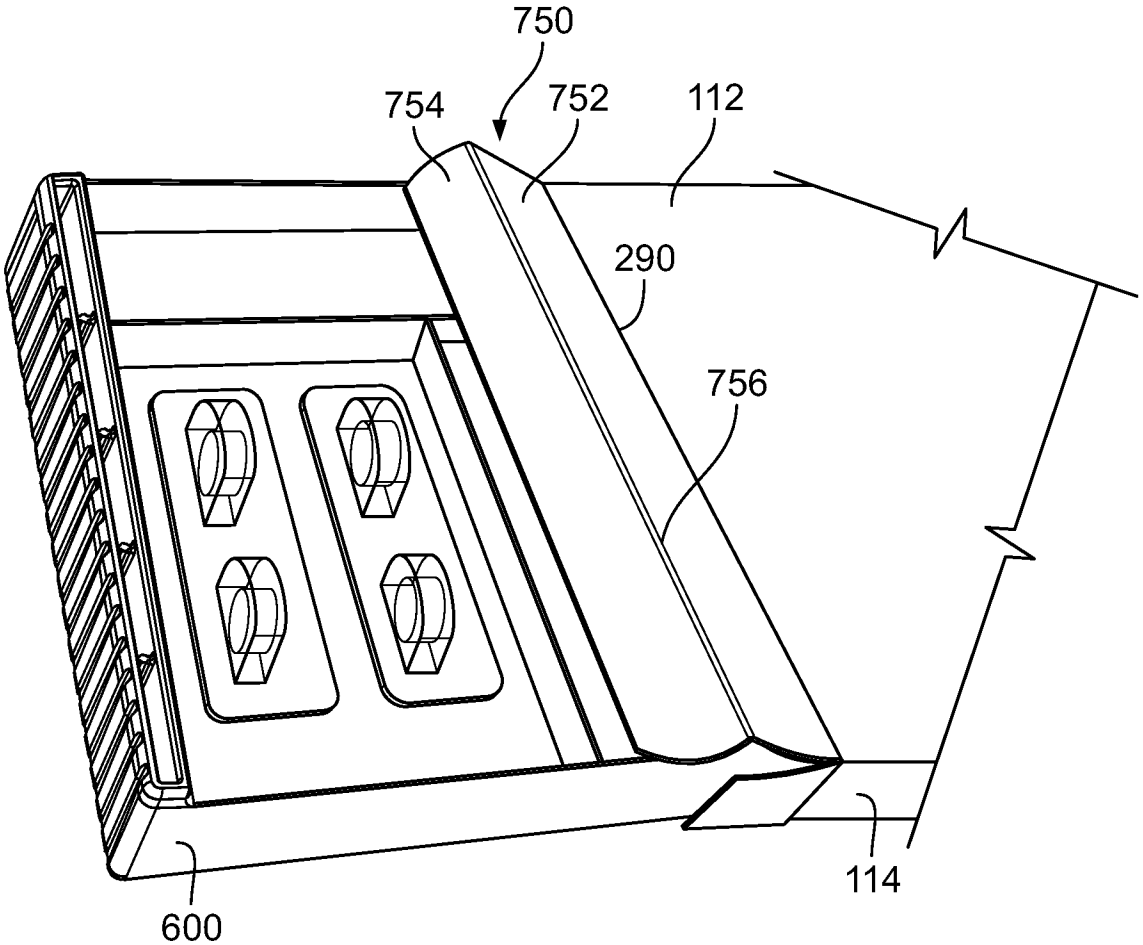
FIG. 10B is a perspective view illustrating an alternative embodiment of forming the medication booklet shown in FIGS. 11-14 using an alternative embodiment of the blank shown in FIG. 1, and the puck and medication blister card shown in FIGS. 7 and 8.

An alternative embodiment of blank 100 is illustrated in FIG. 10B, in which back panel 116 does not include first inner minor end panel 270 or first inner major end panel 272 (all shown in FIG. 1). Rather, first end edge 286 of back panel 116 is a free edge. In addition, outer front panel 112 does not include first outer minor end panel 278 or first outer major end panel 280. Instead, outer front panel 112 includes a tuck flap 750 extending from first end edge 290 of outer front panel 112. Tuck flap 750 includes a first panel 752 and a second panel 754, wherein first panel 752 extends from first end edge 290 to second panel 754, and second panel 754 extends from first panel 752 along a fold line 756. Blank 100 may feature tuck flap 750, for example, to improve the ability of medication booklet 800 to be formed by hand. When medication booklet 800 is formed from blank 100, second panel 754 is rotated about fold line 756 into a substantially perpendicular relationship with first panel 752, and first panel 752 is rotated about a fold line at first end edge 290 until second panel 754 is inserted into a cavity defined by medication booklet 800 (e.g., behind a puck 600) to thereby close medication booklet 800. In such alternative embodiments, puck 600 may not be fully adhered to medication booklet 800 during formation of medication booklet 800 such that puck 600 may be more easily slid into medication booklet 800 and retained therein by closing tuck flap 750.

Figure 12:
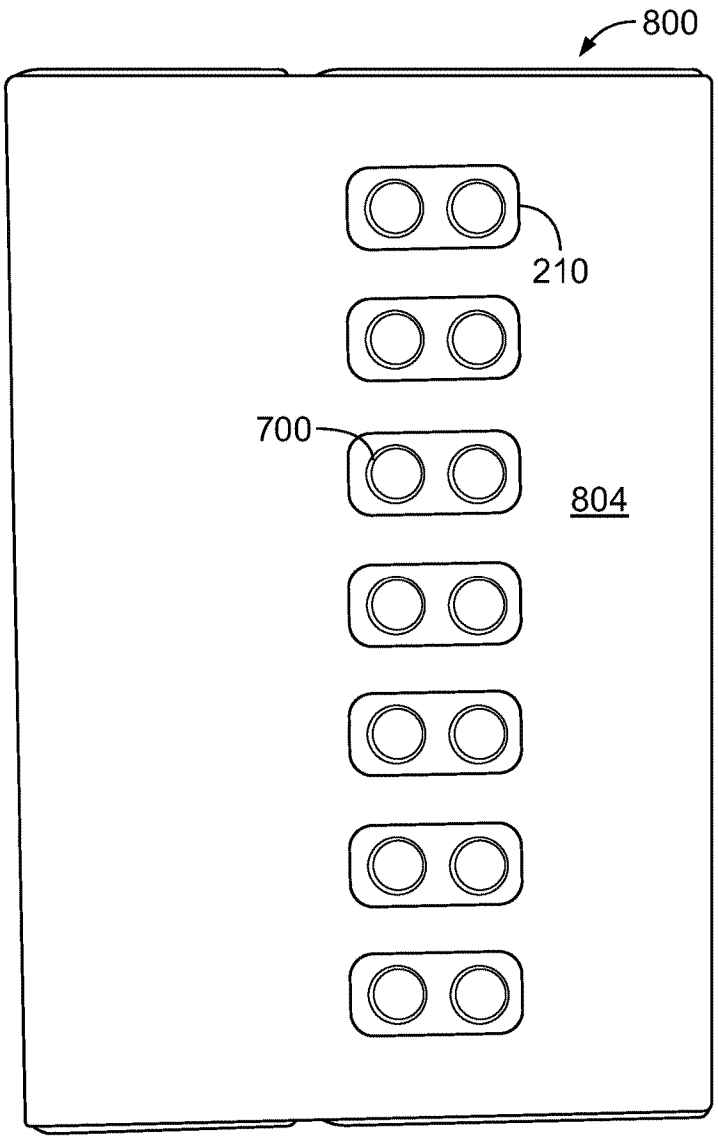
Figure 11:
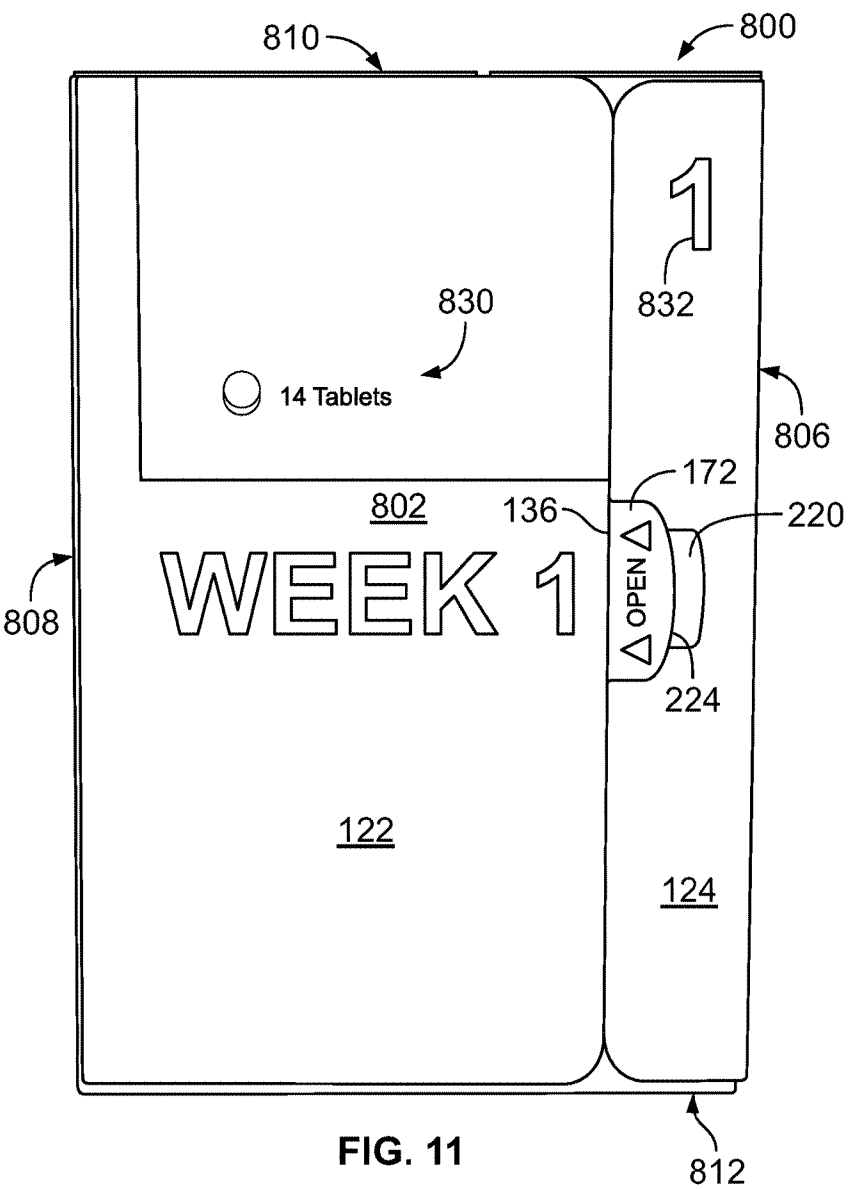
Figure 13:
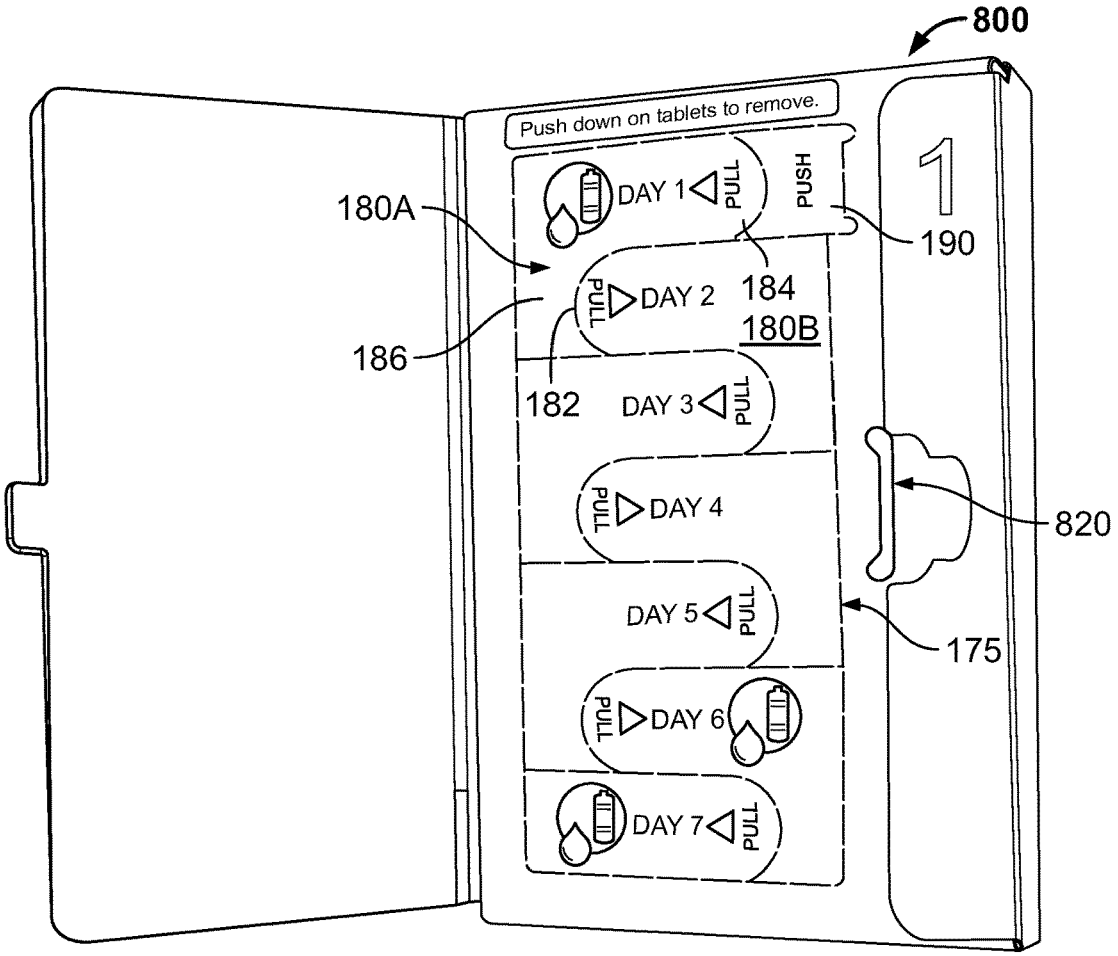
Figure 14:
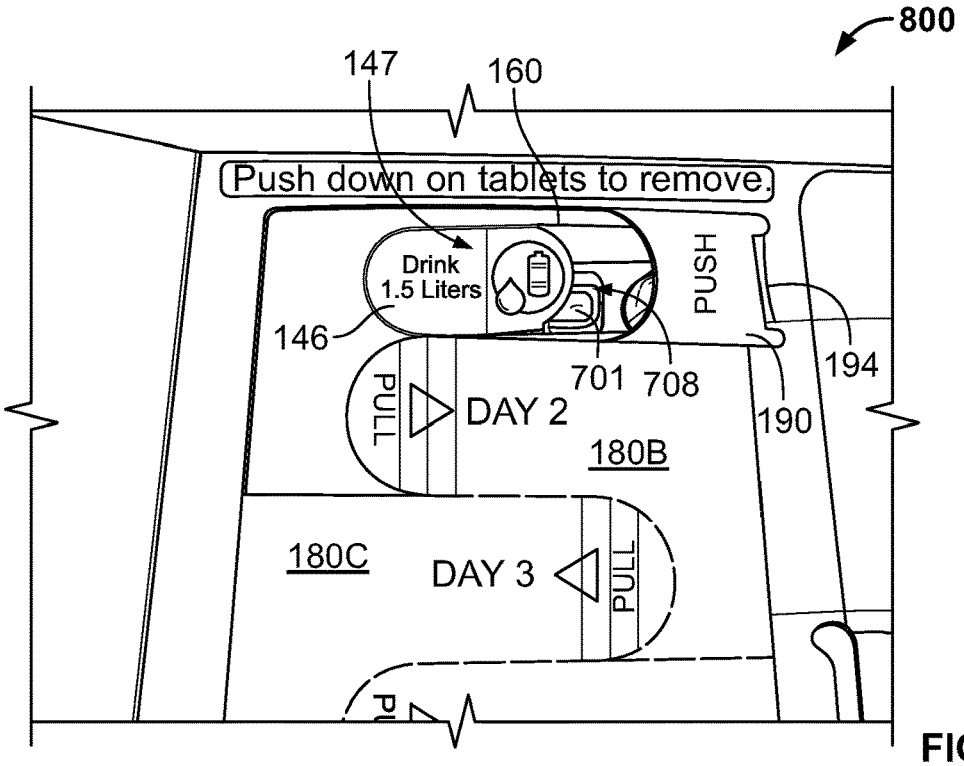

FIGS. 11-14 illustrate various views of a first example embodiment of a medication booklet 800 for use with medication packaging and dispensing system 2000 (shown in FIGS. 24-29). More specifically, FIG. 11 is a top view of medication booklet 800, FIG. 12 a bottom view of medication booklet, FIG. 13 is a perspective view of medication booklet 800 in an open configuration, and FIG. 14 is an enlarged view of medication booklet 800 illustrating sequential tab assembly 175. Medication booklet 800 includes a top wall 802, a bottom wall 804, a first side wall 806, a second side wall 808, a first end wall 810, and a second end wall 812. First side wall 806 is defined by second side panel 118 of blank 100, and second side wall 808 is defined by first side panel 114 of blank 100. In the illustrated embodiment, second side wall 808 is further defined by side glue panel 124. First end wall 810 includes first and third end flaps 250 and 254, first major inner end panel 272, first minor inner end panel 270, first major outer end panel 280, and first minor outer end panel 278 of blank 100. Similarly, second end wall 812 includes second and fourth end flaps 252 and 256, second major inner end panel 276, second minor inner end panel 274, second major outer end panel 284, and second minor outer end panel 282 of blank 100.

As shown in FIG. 12, bottom wall 804 is defined by back panel 116 of blank 100 and includes back cutouts 210. Top wall 802 is at least partially defined by outer front panel 112 and inner front panel 110 of blank. Top wall 802, in the illustrated embodiment, includes indicia 830 printed thereon. Indicia 830 may include, for example, a tradename and/or scientific name of medication 701 contained therein, an image of medication 701, instructions, and/or other words or images identifying a manufacturer of medication 701. Top wall 802 of medication booklet 800 further includes a sequence number 832, which identifies the order in which medication booklet 800 should be accessed in system 2000 (shown in FIGS. 24-29). In the illustrated embodiment, top wall 802 is further defined by front glue panel 120 and, in the closed position (as shown in FIG. 11), cover panel 122 of blank 100. As shown in FIG. 13, top wall 802 includes sequential tab assembly 175 and access flap 190. Though not shown in FIGS. 11-14, each of tail portions 186 of pull tabs 180 of sequential tab assembly 175 aligns with an empty blister module 710 of blister card 700. This alignment provides additional rigidity underneath each tail portion 186 of pull tabs 180, making it more difficult to exert a force on tail portion 186 of a pull tab 180 that would enable the subsequent pull tab 180 to be removed out of sequence. In other words, aligning tail portions 186 with empty blister modules 710 optimizes sequential tab assembly 175, further preventing access to a "future" pull tab 180 before the "current" pull tab 180 is removed, which also improves the child resistance of medication booklet 800.

To open medication booklet 800, a user may engage edge 224 of locking tab 172 using access opening 220 and exert a force on locking tab 172, such that locking tab 172 de-couples from front glue panel 120 along perforation lines 136B, rotating about fold line 136. Upon further exertion of force on locking tab 172, cover panel 122 de-couples from front glue panel 124 along perforation lines 136A. Cover panel 122 is rotated outwardly about fold line 138, exposing outer front panel 112. The user may close medication booklet 800 by rotating locking tab 172 toward interior surface 102 of cover panel 122, rotating cover panel 122 inwardly, and inserting locking tab 172 through locking slot 820 (defined by inner locking slot 168 aligned with outer locking slot 170).

To dispense medication from medication booklet 800, the user first depresses access flap 190 inwardly (through first portion 164 of access opening 162 of top front cutout 160), which enables the user to access grip portion 184 of first pull tab 180A in sequential tab assembly 175. Upon exertion of an outward force on first pull tab 180A, first pull tab 180A de-couples from top wall 802 along perforation line 182 defined along a perimeter of first pull tab 180A. As shown in FIG. 14, top front cutout 160 is exposed when first pull tab 180A is removed. In the illustrated embodiment, top front cutout 160 includes reminder tab 146. Reminder tab 146 is printed with indicia 147 configured to provide a reminder message to the user. For example, indicia 147 on reminder tab 146 may remind the user of instructions associated with taking the first dose of medication 701, such as "take with food" or "drink X amount of water." Reminder tab 146 is de-coupled from top wall 802 upon an outward exertion of force thereon. Medication blister modules 708 (e.g., corresponding to the first daily dose of medication 701) are exposed through top front cutout 160. To dispense medication 701 from medication booklet 800, the user exerts a force upon medication blister module 708, through top front cutout 160 (e.g., towards bottom wall 804 of medication booklet 800). The force is transferred through medication 701 contained in medication blister module 708, which causes the foil material of second surface 704 of blister card 700 to rupture or tear, thereby forming an opening through which medication 701 is accessed.

FIGS. 15A and 15B illustrate a second example embodiment of a medication booklet 900. More specifically, FIG. 15A is a view of a top wall 902 of medication booklet 900, and FIG. 15B is a view of a back wall 904 of medication booklet 900. As described with respect to blank 300 (shown in FIG. 2), back wall 904 of medication booklet 900 includes punch-out tabs 312 within back cutouts 310. In addition, top wall 902 includes sequence number 932, here the numeral "2" to indicate that medication booklet 900 is the second booklet to be accessed in system 2000 (shown in FIGS. 24-29).

FIGS. 16A and 16B illustrate a third example embodiment of a medication booklet 1000. More specifically, FIG. 16A is a view of a top wall 1002 of medication booklet 1000, and FIG. 16B is a view of a back wall 1004 of medication booklet 1000. As described with respect to blank 400 (shown in FIG. 3), back wall 1004 of medication booklet 1000 includes back cutouts 410. In addition, top wall 1002 includes sequence number 1032, here the numeral "3" to indicate that medication booklet 1000 is the third booklet to be accessed in system 2000 (shown in FIGS. 24-29).

FIGS. 17A and 17B illustrate a fourth example embodiment of a medication booklet 1100. More specifically, FIG. 17A is a view of a top wall 1102 of medication booklet 1100, and FIG. 17B is a view of a back wall 1104 of medication booklet 1100. As described with respect to blank 500 (shown in FIG. 4), back wall 1104 of medication booklet 1100 includes back cutouts 510. In addition, top wall 1102 includes sequence number 1132, here the numeral "4" to indicate that medication booklet 1100 is the fourth booklet to be accessed in system 2000 (shown in FIGS. 24-29).

The illustrated embodiments of medication booklet 800 (shown in FIGS. 11-14), medication booklet 900 (shown in FIGS. 15A and 15B), medication booklet 1000 (shown in FIGS. 16A and 16B), and medication booklet 1100 (shown in FIGS. 17A and 17B), as constructed from respective blanks 100 (shown in FIG. 1), 300 (shown in FIG. 2), 400 (shown in FIG. 3), and 500 (shown in FIG. 4), have a plurality of child-resistance features, as described herein. In addition, medication booklets 800, 900, 1000, 1100 include a plurality of compliance features as well as indicia for ease of use by adults, for example, seniors. In tests conducted with seniors and children according to U.S. Consumer Product Safety Commission (CPSC) protocol, the illustrated embodiment of these booklets met the criteria of the F=1 level (minimum 90% failure).

Figure 18:
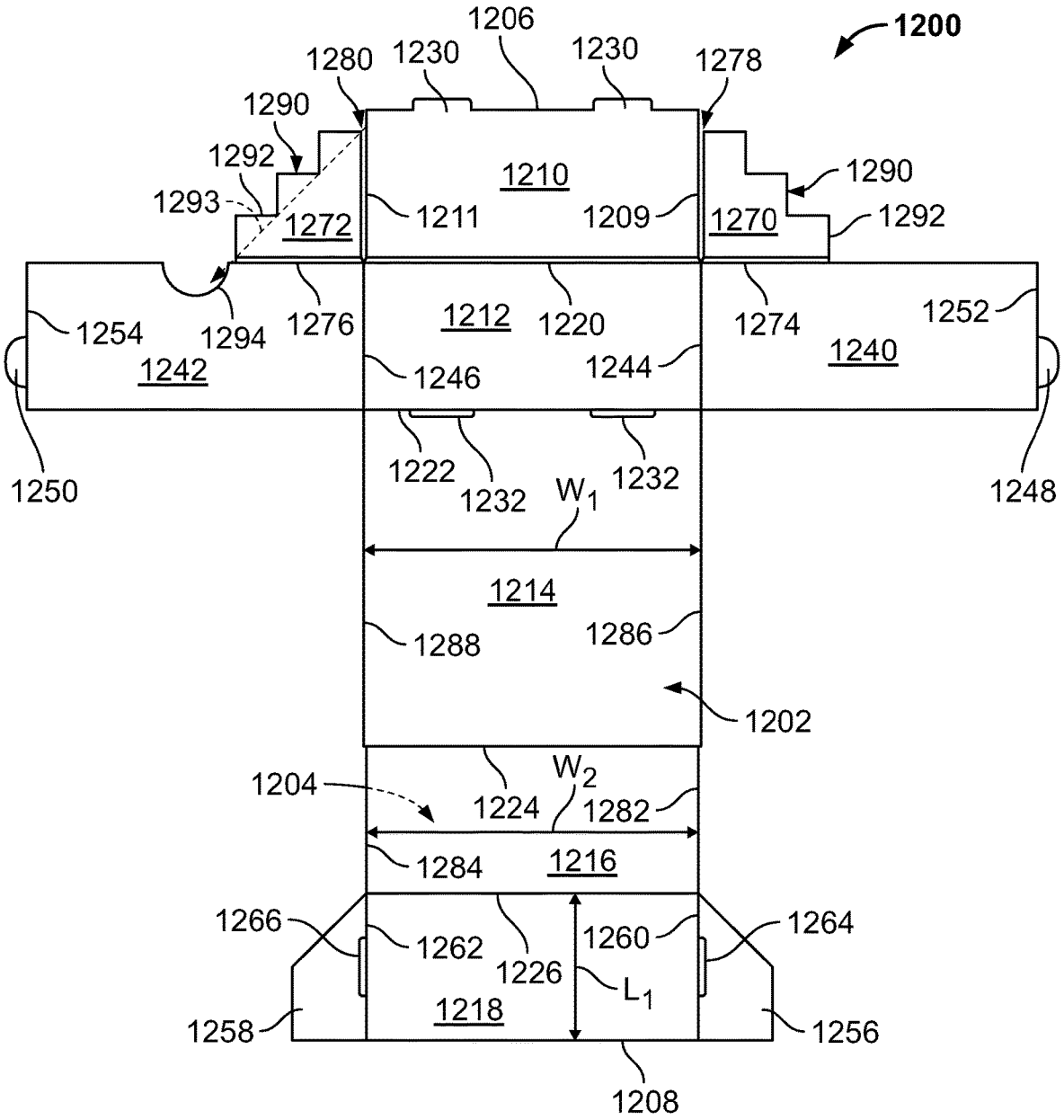

FIG. 18 illustrates a top plan view of a blank 1200 for constructing a tray 1300 (shown in FIG. 19) for use with medication packaging and dispensing system 2000 (shown in FIGS. 24-29). Blank 1200 has a first or interior surface 1202 and an opposing second or exterior surface 1204. Further, blank 1200 defines a first or leading edge 1206 and an opposing second or trailing edge 1208. In the illustrated embodiment, blank 1200 includes, from leading edge 1206 to trailing edge 1208, an inner side panel 1210, a first outer side panel 1212, a bottom panel 1214, a riser panel 1216, and a second outer side panel 1218. Panels 1210, 1212, 1214, 1216, and 1218 are coupled together by a plurality of generally parallel fold lines 1220, 1222, 1224, and 1226. More specifically, inner side panel 1210 extends from leading edge 1206 to fold line 1220, first outer side panel 1212 extends from fold line 1220, bottom panel 1214 extends from fold line 1222, riser panel 1216 extends from fold line 1224, and second outer side panel 1218 extends from fold line 1226 to trailing edge 1208. Fold lines 1220, 1222, 1224, and 1226, as well as other fold lines and/or hinge lines described herein, may include any suitable line of weakening and/or line of separation known to those skilled in the art and guided by the teachings herein provided.

Inner side panel 1210 includes a pair of bottom locking tabs 1230 defined along a free edge thereof (e.g., leading edge 1206 of blank 1200). In addition, bottom panel 1214 includes a pair of bottom locking slots 1232 defined along fold line 1222 and extending into bottom panel 1214. The pair of bottom locking slots 1232 are configured to receive bottom locking tabs 1230 when tray 1300 is formed from blank 1200.

First outer side panel 1212 includes a first end panel 1240 extending from a first end edge 1244 thereof and a second end panel 1242 extending from an opposing second end edge 1246 thereof. First end panel 1240 includes a first side locking tab 1248 extending from an end edge 1252 thereof opposite first outer side panel 1212. Similarly, second end panel 1242 includes a second side locking tab 1250 extending from an end edge 1254 thereof opposite first outer side panel 1212. second outer side panel 1218 includes a first support flap 1256 extending from a first end edge 1260 thereof and a second support flap 1258 extending from an opposing second end edge 1262 thereof. A first side locking slot 1264 is defined in first support flap 1256, extending into first support flap 1256 from a fold line defined along first end edge 1260 of second outer side panel 1218. A second side locking slot 1266 is defined in second support flap 1258, extending into second support flap 1258 from a fold line defined along second end edge 1262 of second outer side panel 1218. When tray 1300 is formed from blank 1200, first and second side locking slots 1264, 1266 receive first and second side locking tabs 1248, 1250 therein, respectively.

First end panel 1240 further includes a first guide panel 1270 extending from a top edge 1274 thereof, and second end panel 1242 further includes a second guide panel 1272 extending from a top edge 1276 thereof. A first gap 1278 is defined between first guide panel 1270 and a first end edge 1209 of inner side panel 1210, and a second gap 1280 is defined between second guide panel 1272 and a second end edge 1211 of inner side panel 1210. First and second guide panels 1270, 1272 each have a plurality of linear "stops" 1290 along a free edge 1292 thereof. Free edge 1292 has a pitch 1293. Each stop 1290 is oriented in a substantially perpendicular relationship from each adjacent stop 1290, defining a substantially identical "stepped" configuration in first and second guide panels 1270, 1272. When tray 1300 is formed form blank 1200, first and second guide panels 1270, 1272 are coupled in a face-to-face relationship with first and second end panels 1240, 1242, respectively, and the plurality of linear stops 1290 of first guide panel 1270 substantially align with the plurality of linear stops 1290 of second guide panel 1272. Moreover, first guide panel 1270 is retained in first gap 1278, between first end edge 1209 of inner side panel 1210 and first end panel 1240, and second guide panel 1272 is retained in second gap 1280, between second end edge 1211 of inner side panel 1210 and second end panel 1240. Second outer side panel 1218 is rotated into a substantially perpendicular relationship to bottom panel 1214, positioning riser panel 1216 at an oblique angle relative to bottom panel 1214. Side locking slots 1264, 1266 receive side locking tabs 1248, 1250. Accordingly, tray 1300 is configured to receive medication booklets 800, 900, 1000, and/or 1100 and retain medication booklets 800, 900, 1000, and/or 1100 in a staggered configuration therein, as described further herein.

In addition, bottom panel 1214 has a width $W_1$, and riser panel 1216 has a width $W_2$. Width $W_2$ is smaller than width $W_1$ by about twice a thickness of blank 1200. When tray 1300 is formed from blank 1200, reduced width $W_2$ enables interior surface 1202 of first end panel 1240 to be flush with a first end edge 1282 of riser panel 1216, such that first end panel 1240 is coplanar with a first end edge 1286 of bottom panel 1214 to form a planar back wall 1310 of tray 1300. Similarly, reduced width $W_2$ permits interior surface 1202 of second end panel 1242 to be flush with a second end edge 1284 of riser panel 1216, such that second end panel 1242 is coplanar with a second end edge 1288 of bottom panel 1214 to form a planar front wall 1308 of tray 1300. Moreover, second outer side panel 1218 has a first length $L_1$. When tray 1300 is formed from blank 1200, rotation of second outer side panel 1218 into a perpendicular relationship with bottom panel 1214 positions riser panel 1216 at an oblique angle with respect to bottom panel 1214. Length $L_1$ of second outer side panel 1218 defines the oblique angle between riser panel 1216 and bottom panel 1214 by controlling how "high" an edge of riser panel 1216 adjacent fold line 1226 will rise.

Figure 26:
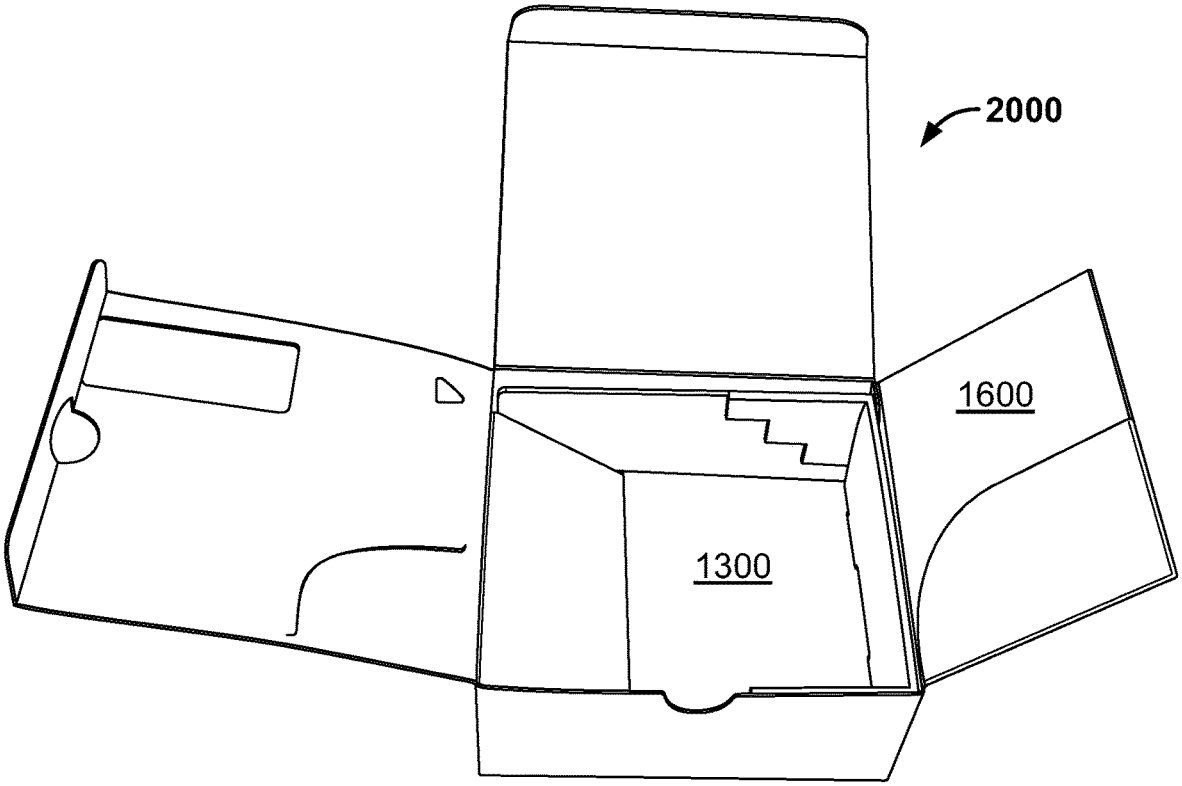

In the illustrated embodiment, second end panel 1242 further includes an access cutout 1294 defined along top edge 1276 thereof. Access cutout 1294 is configured to correspond to an access cutout 1464 defined in a front wall 1604 of a container 1600 of system 2000 (as shown in FIG. 26).

Figure 19:
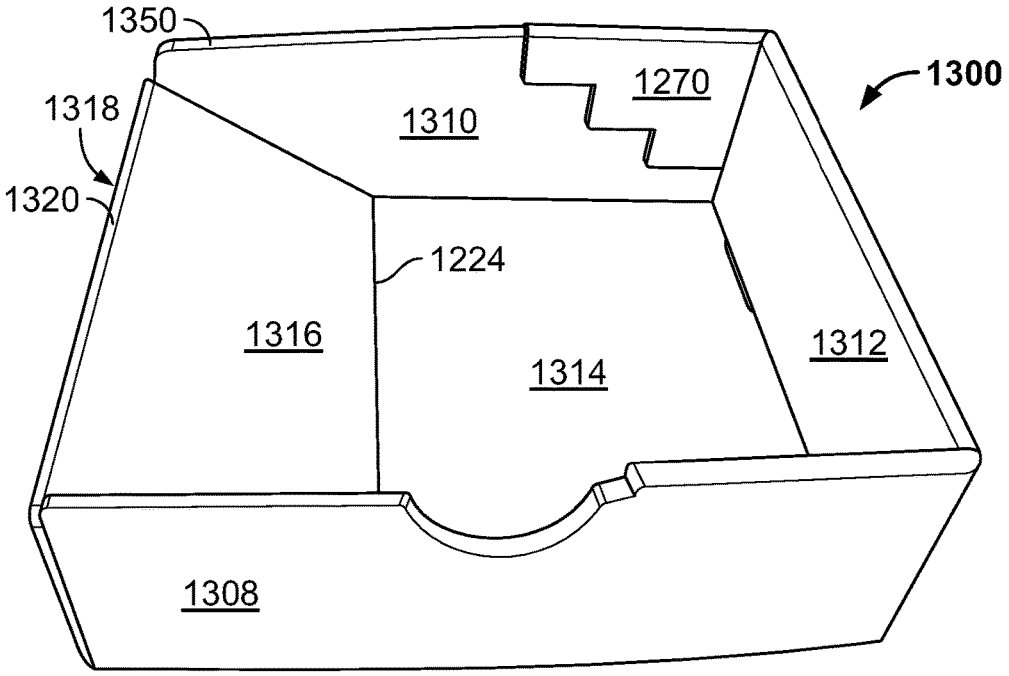

FIG. 19 is a perspective view of a tray 1300 formed from blank 1200 shown in FIG. 18, for use with medication packaging and dispensing system 2000 (shown in FIGS. 24-29). Tray 1300 includes a bottom wall 1314, a first side wall 1312, a second side wall 1318, a first end wall 1310 (also referred to herein as a "back wall"), a second end wall 1308 (also referred to herein as a "front wall"), and a riser 1316. Bottom wall 1314 is defined by bottom panel 1214 of blank 1200, riser 1316 is defined by riser panel 1216, and second side wall 1318 is defined by second outer side panel 1218. First side wall 1312 is defined by first outer side panel 1212 and inner side panel 1210. Back wall 1310 is defined by first end panel 1240, and front wall 1308 is defined by second end panel 1242.

To form tray 1300 from blank 1200, inner side panel 1210 is rotated about fold line 1220 into a face-to-face relationship with first outer side panel 1212. In the illustrated embodiment, interior surface 1202 of inner side panel 1210 is coupled against interior surface 1202 of first outer side panel 1212. first outer side panel 1212 is rotated towards bottom panel 1214 along fold line 1222 into a substantially perpendicular relationship with bottom panel 1214, and bottom locking tabs 1230 engage bottom locking slots 1232 to lock inner side panel 1210 against first outer side panel 1212, thereby forming first side wall 1312.

First guide panel 1270 is rotated about a fold line along top edge 1274 of first end panel 1240 into a face-to-face relationship with first end panel 1240. Second guide panel 1272 is rotated about a fold line along top edge 1276 of second end panel 1242 into a face-to-face relationship with second end panel 1242. First end panel 1240 is rotated about a fold line at first end edge 1244 of first outer side panel 1212 into a substantially perpendicular relationship with first side wall 1312. First guide panel 1270 is received in first gap 1278 between first end edge 1209 of inner side panel 1210 and first end panel 1240. Second end panel 1242 is rotated about a fold line at second end edge 1246 of first outer side panel 1212 into a substantially perpendicular relationship with first side wall 1312. Second guide panel 1272 is received in second gap 1280 between second end edge 1211 of inner side panel 1210 and second end panel 1242.

Second outer side panel 1218 is rotated about fold line 1226 away from interior surface 1202 of bottom panel 1214 (that is, outwardly) into a substantially perpendicular relationship with bottom panel 1214, thereby forming second side wall 1318 and defining bottom wall 1314. This rotating positions riser 1316 at an oblique angle with respect to bottom wall 1314, riser 1316 extending between fold line 1224 in a plane defined by bottom wall 1314 to a top edge 1320 of second side wall 1318.

First support flap 1256 is rotated toward exterior surface 1204 of second outer side panel 1218 into a substantially perpendicular relationship therewith, and second support flap 1258 is rotated toward exterior surface 1204 of second outer side panel 1218 into a substantially perpendicular relationship therewith. First side locking tab 1248 is rotated inwardly and inserted into first side locking slot 1264 to lock back wall 1310 in place. Similarly, second side locking tab 1250 is rotated inwardly and inserted into second side locking slot 1266 to lock front wall 1308 in place.

Figure 20:
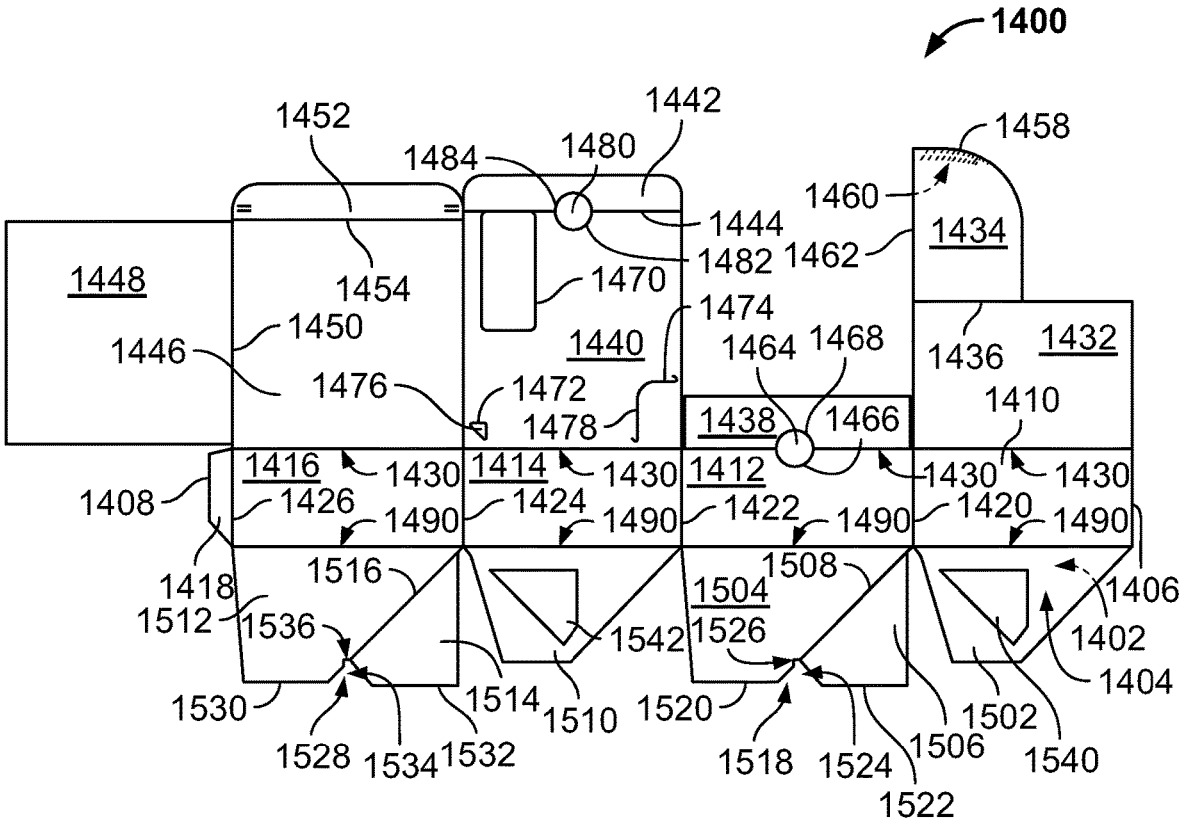

FIG. 20 is a top plan view of an example embodiment of a blank 1400 for forming a container 1600 (shown in FIGS. 21-23) for a medication packaging and dispensing system 2000 (shown in FIGS. 24-29). Blank 1400 has a first or interior surface 1402 and an opposing second or exterior surface 1404. Further, blank 1400 defines a first or leading edge 1406 and an opposing second or trailing edge 1408. In the illustrated embodiment, blank 1400 includes, from leading edge 1406 to trailing edge 1408, a first side panel 1410, a front panel 1412, a second side panel 1414, a back panel 1416, and a glue flap 1418. Panels 1410, 1412, 1414, 1416, and 1418 are coupled together by a plurality of generally parallel fold lines 1420, 1422, 1424, and 1426 More specifically, first side panel 1410 extends from leading edge 1406 to fold line 1420, front panel 1412 extends from fold line 1420, second side panel 1414 extends from fold line 1422, back panel 1416 extends from fold line 1424, and glue flap 1418 extends from fold line 1426 to trailing edge 1408. Fold lines 1420, 1422, 1424, and 1426, as well as other fold lines and/or hinge lines described herein, may include any suitable line of weakening and/or line of separation known to those skilled in the art and guided by the teachings herein provided.

In addition, panels 1410, 1412, 1414, 1416, and 1418 define a top edge 1430 that is substantially perpendicular to fold lines 1420, 1422, 1424, and 1426. In the illustrated embodiment, a plurality of panels extends from top edge 1430. More particularly, a major envelope panel 1432 extends from top edge 1430 of first side panel 1410, a front reinforcement panel 1438 extends from top edge 1430 of front panel 1412, an inner top panel 1440 extends from top edge 1430 of second side panel 1414, and an outer top panel 1446 extends from top edge 1430 of back panel 1416.

A minor envelope panel 1434 extends from a top edge 1436 of major envelope panel 1432 opposite first side panel 1410. Minor envelope panel 1434 includes an adhesive region 1460 along a free edge 1458 of interior surface 1402 thereof. When container 1600 is formed from blank 1400, minor envelope panel 1434 is adhered to major envelope panel 1432 along adhesive region 1460, major and minor envelope panels 1432, 1434 cooperating to form an envelope 1616 (shown in FIG. 22). Minor envelope panel 1434 may further include a glue tab (not shown) extending from a side edge 1462 thereof. The glue tab may be coupled to major envelope panel 1432 to ensure that materials enclosed in envelope 1616 do not fall through a bottom edge thereof.

In the illustrated embodiment, the front panel 1412 and front reinforcement panel 1438 include an access cutout 1464 defined therein. More specifically, a first portion 1466 of access cutout 1464 extends into front panel 1412 from top edge 1430, and a second portion 1468 of access cutout 1464 extends substantially symmetrically to first portion 1466 into front reinforcement panel 1438 from top edge 1430. When container 1600 is formed from blank 1400, front reinforcement panel 1438 is rotated to couple against front panel 1412 in a face-to-face relationship. Accordingly, access cutout 1464 having substantially symmetrical first and second portion 1466, 1468 defined in both front panel 1412 and front reinforcement panel 1438 ensures a well-defined access cutout 1464 in container 1600. Access cutout 1464 may be other than substantially symmetrically oriented across top edge 1430 of front panel 1412. For example, in alternative embodiments, second portion 1468 may extend further into front reinforcement panel 1438, or first portion 1466 may extend further into front panel 1412.

Figure 24:
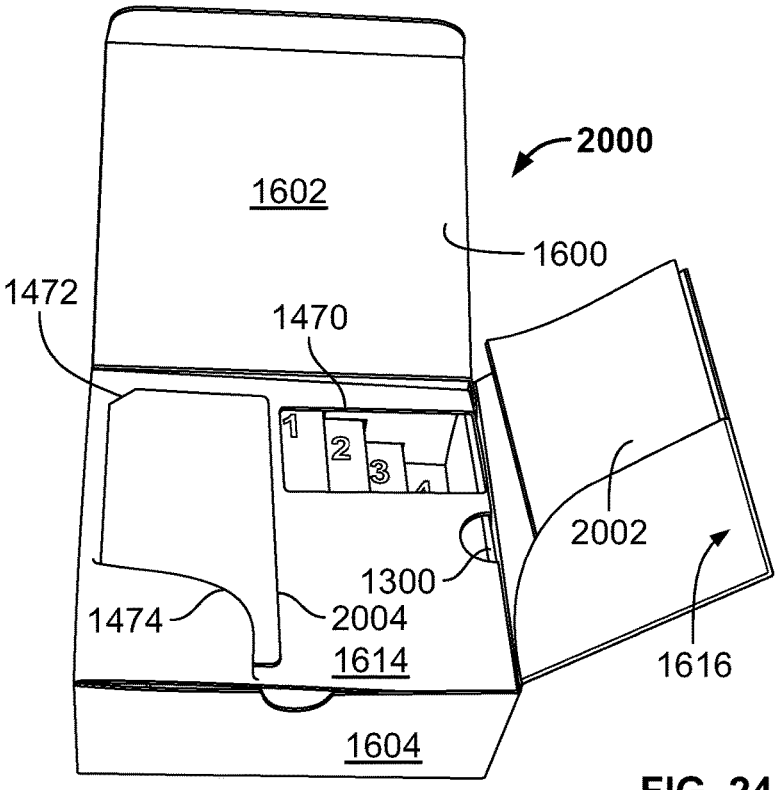

Inner top panel 1440 includes a window 1470 defined therein. When container 1600 is formed from blank 1400, window 1470 enables a user of container 1600 to view medication booklets 800, 900, 1000, and/or 1100 included therein (as shown in FIG. 24). In addition, inner top panel 1440 includes a corner catch 1472 and a corner anchor 1474. Corner catch 1472 is defined by an opening 1476 in inner top panel 1440, configured to receive and engage a corner of instructional, educational, or safety materials included in container 1600 (as shown in FIG. 24). Corner anchor 1474 includes a cut line 1478, configured to receive and engage another corner and/or another portion of the materials included in container 1600 (also shown in FIG. 24).

Figure 22:
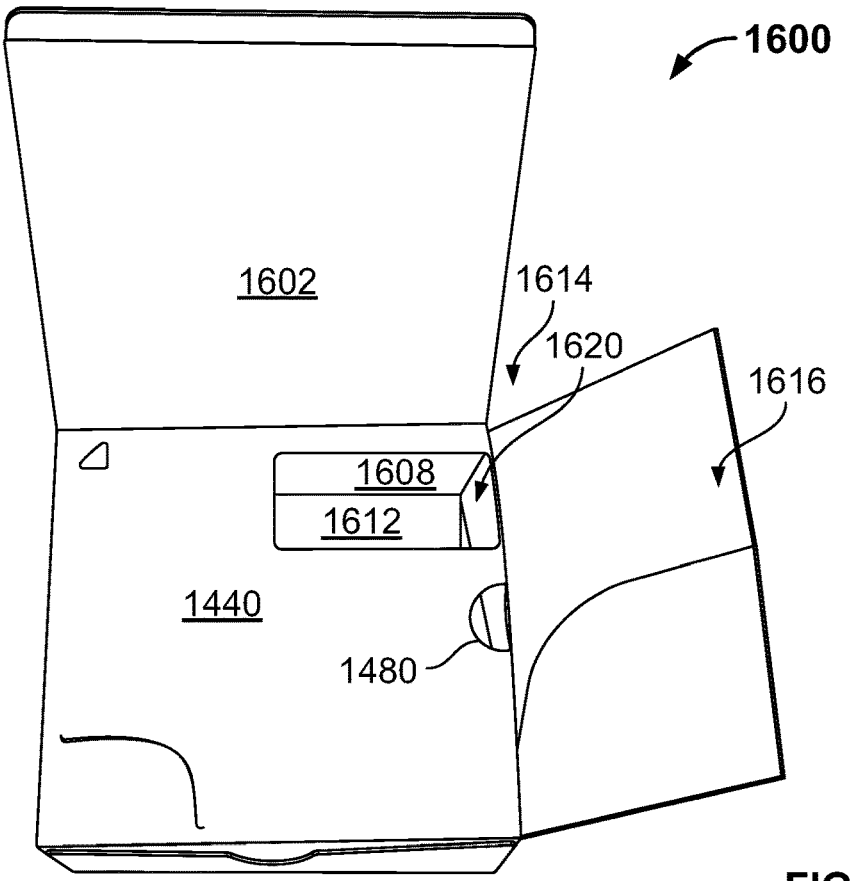

Inner top panel 1440 further includes a closure lip 1442 extending from a top edge 1444 thereof. When container 1600 is formed from blank 1400, closure lip 1442 is rotated into a substantially perpendicular relationship to inner top panel 1440. Closure lip 1442 is inserted into a cavity 1620 defined by container 1600, engaging a side wall 1606 of container 1600, to cover cavity 1620 (as shown in FIG. 22).

An access cutout 1480 is defined in inner top panel 1440 and closure lip 1442. In the illustrated embodiment, a first portion 1482 of access cutout 1480 extends into inner top panel 1440 from top edge 1444, and a second portion 1484 extends substantially symmetrically to first portion 1482 from top edge 144 into closure lip 1442. Access cutout 1480 enables a user of container 1600 to engage interior surface 1402 of inner top panel 1440 and rotate inner top panel 1440 away from cavity 1620 of container 1600 (e.g., open container 1600 to expose cavity 1620 and any contents of container 1600).

A top reinforcement panel 1448 extends from a side edge 1450 of outer top panel 1446. When container 1600 is formed from blank 1400, top reinforcement panel 1448 is coupled against outer top panel 1446 in a face-to-face relationship, to reinforce outer top panel 1446 and define a reinforced top wall 1602 of container 1600. Accordingly, top reinforcement panel 1448 has dimensions that are approximately the same as or smaller than dimensions of outer top panel 1446. A closure lip 1452 extends from a top edge 1454 of outer top panel 1446. When container 1600 is formed from blank 1400, closure lip 1452 is rotated into a substantially perpendicular relationship to outer top panel 1446. Closure lip 1452 is configured to be inserted into cavity 1620 of container 1600, engaging a front wall 1604 of container 1600 (e.g., in a friction fit) to close container 1600.

Panels 1410, 1412, 1414, and 1416 further define a bottom edge 1490 that is substantially perpendicular to fold lines 1420, 1422, 1424, and 1426. In the illustrated embodiment, a plurality of panels extends from bottom edge 1490. More particularly, a first minor bottom panel 1502 extends from bottom edge 1490 of first side panel 1410, a first major bottom panel 1504 extends from bottom edge 1490 of front panel 1412, a second minor bottom panel 1510 extends from bottom edge 1490 of second side panel 1414, and a second major bottom panel 1512 extends from bottom edge 1490 of back panel 1416. first major bottom panel 1504 includes a first joining tab 1506 extending therefrom along a fold line 1508, and a first locking juncture 1518 defined by a free edge 1520 of first major bottom panel 1504 and a free edge 1522 of first joining tab 1506. Similarly, second major bottom panel 1512 includes a second joining tab extending therefrom along a fold line 1516, and a second locking juncture 1528 defined by a free edge 1530 of second major bottom panel 1512 and a free edge 1532 of second joining tab 1514. First and second locking junctures 1518, 1528 each include a major cutout 1524, 1534 and a minor cutout 1526, 1536, respectively. First minor bottom panel 1502 includes a first adhesive region 1540. Similarly, second minor bottom panel 1510 includes a second adhesive region 1542. When container 1600 is formed from blank 1400, first and second major bottom panels 1504, 1512 and first and second minor bottom panels 1502, 1510 cooperate to form a bottom wall 1612 of container 1600. More particularly, adhesive region 1540 of first minor bottom panel 1502 is coupled in a face-to-face relationship with first joining tab 1506, and adhesive region 1542 of second minor bottom panel 1510 is coupled in a face-to-face relationship with second joining tab 1514. Locking junctures 1518, 1528 are configured to engage one another to lock bottom wall 1612. More particularly, secondary cutouts 1526, 1536 of locking junctures 1518, 1528 engage one another to lock bottom wall 1612 in a planar orientation.

Figure 21:
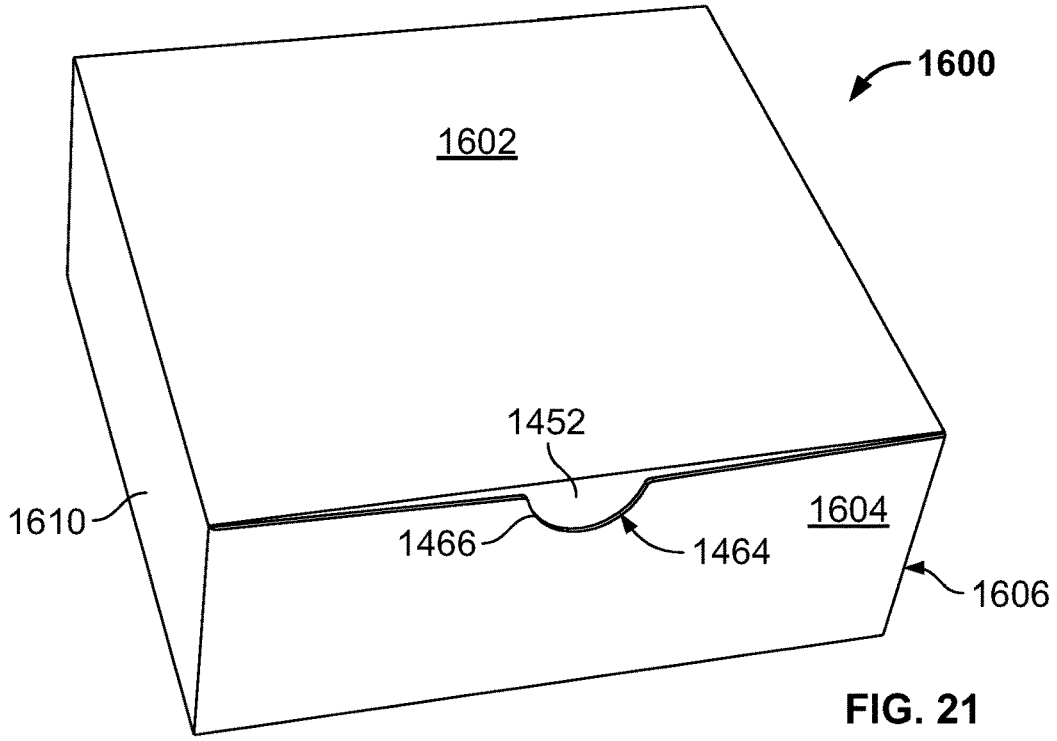
Figure 23:
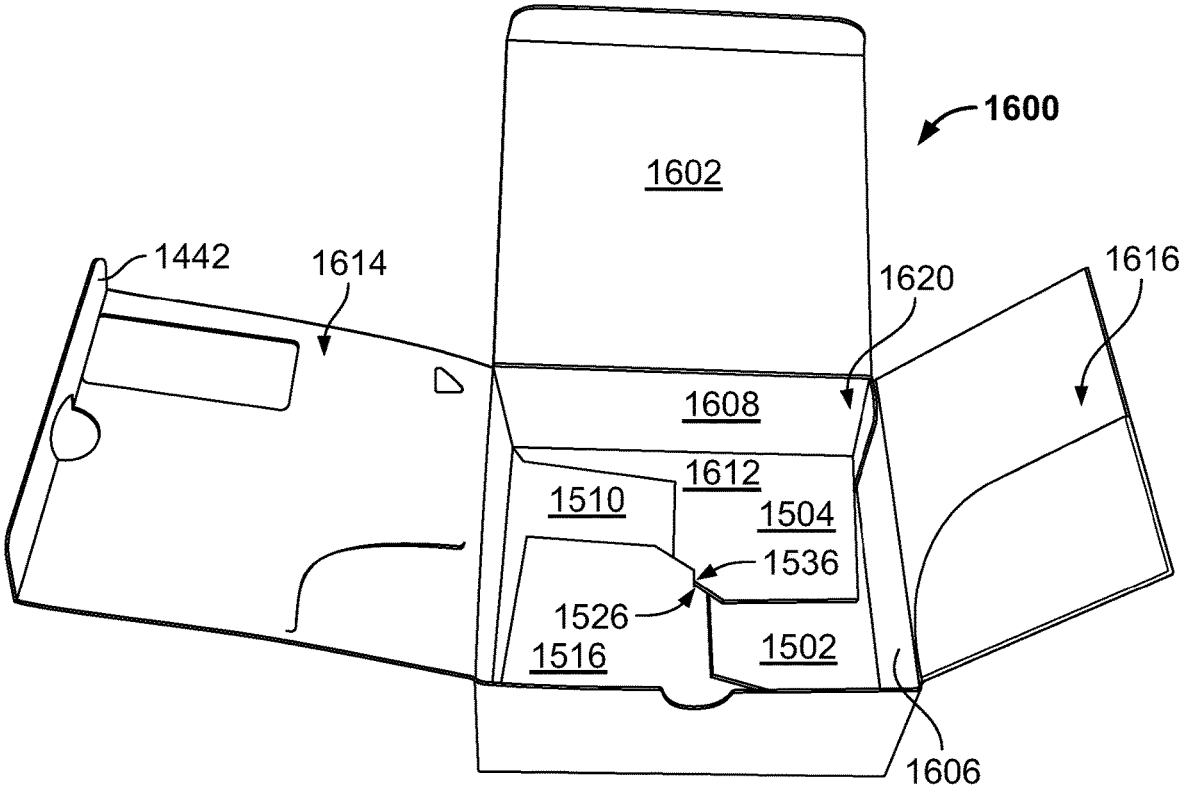

FIGS. 21-23 illustrate an example embodiment of a container 1600 formed from blank 1400 of FIG. 20, for use in medication packaging and dispensing system 2000 (shown in FIGS. 24-29), in various configurations. FIG. 21 is a perspective view of container 1600 in a fully closed configuration, FIG. 22 is a perspective view of container 1600 in an intermediate open configuration, and FIG. 23 is a perspective view of container 1600 in a fully open configuration (e.g., to receive tray 1300, shown in FIG. 19). Container 1600 includes a top wall 1602, a front wall 1604, a first side wall 1606, a back wall 1608, a second side wall 1610, and a bottom wall 1612. Any or all of wall 1602, 1604, 1606, 1608, 1610, and/or 1612 may include printing or indicia thereon to provide safety warnings and/or instructional guidance to a user of container 1600, and/or to indicate the medication contained therein.

In the illustrated embodiment, top wall 1602 is defined by top panel 1446 and top reinforcing panel 1448 of blank 1400. Bottom wall 1612 is defined by first and second major bottom panels 1504, 1512 and first and second minor bottom panels 1502, 1510. First side wall 1606 is defined by first side panel 1410 and glue flap 1408, and second side wall 1610 is defined by second side panel 1414. Back wall 1608 is defined by back panel 1416, and front wall 1604 is defined by front panel 1412 and front reinforcement panel 1438.

To form container 1600 from blank 1400, glue flap 1418 is rotated about fold line 1426, and back panel 1416 is rotated about fold line 1424 to position glue flap 1418 into a face-to-face relationship with first side panel 1410. In the illustrated embodiment, exterior surface 1404 of glue flap 1418 is adhered or otherwise secured to interior surface 1402 of first side panel 1410.

In the illustrated embodiment, first joining tab 1506 is rotated to couple exterior surface 1404 of first joining tab 1506 against exterior surface 1404 of first major bottom panel 1504. Similarly, second joining tab 1514 is rotated to couple exterior surface 1404 of second joining tab 1514 against exterior surface 1404 of second major bottom panel 1512. Additionally, adhesive is applied to first and second adhesive regions 1540, 1542 of first and second minor bottom panels 1502, 1510, respectively. First joining tab 1506 is coupled in a face-to-face relationship with first minor bottom panel 1502, and second joining tab 1514 is coupled in a face-to-face relationship with second minor bottom panel 1510. More specifically, interior surface 1402 of first joining tab 1506 is adhered in a face-to-face relationship with exterior surface 1404 of first minor bottom panel 1502, and interior surface 1402 of second joining tab 1514 is coupled in a face-to-face relationship with exterior surface 1404 of second minor bottom panel 1510. At this stage, container 1600 is in a "knocked-down-flat" configuration (not shown), in which exterior surface 1404 of blank 1400 is substantially exposed, and interior surface 1402 of blank 1400 is only minimally exposed. Container 1600 may be stored and/or shipped in the knocked-down flat configuration, to save space and/or shipping costs. Container 1600 may be shifted into an open-bottom configuration, as shown in FIG. 23, in which minor cutouts 1526, 1536 of locking junctures 1518, 1528 engage one another lock bottom wall 1612 in a planar configuration, such that container 1600 is ready for use.

To form top wall 1602 of container 1600, top reinforcement panel 1448 is rotated about a fold line along side edge 1450 of outer top panel 1446 into a face-to-face relationship with outer top panel 1446. More particularly, interior surface 1402 of top reinforcement panel 1448 is adhered or otherwise secured to interior surface 1402 of outer top panel 1446.

To form front wall 1604 of container 1600, front reinforcement panel 1438 is rotated about a fold line at top edge 1430 of front panel 1412 into a face-to-face relationship with front panel 1412. More particularly, interior surface 1402 of front reinforcement panel 1438 is adhered or otherwise secured to interior surface 1402 of front panel 1412.

Front wall 1604 includes access cutout 1464, as defined by first portion 1466 extending into front panel 1412 of blank 1400 and second portion 1468 extending into front reinforcement panel 1438. Closure lip 1452 extending from top wall 1602 engages in a friction fit with front wall 1604 to releasably close container 1600. To open container 1600, user may engage closure lip 1452 through access cutout 1464 and urge top wall 1602 upward, rotating top wall 1602 about a fold line on a top edge of back wall 1608.

Referring now to FIG. 22, top wall 1602 is rotated away from a cavity 1620 defined by container 1600, exposing an inner top wall 1614 defined by inner top panel 1440 of blank 1400. Inner top wall 1614 may be further defined by an envelope 1616. Envelope 1616, defined by major and minor envelope panels 1432, 1434 of blank 1400, is rotated away from cavity 1620 about a fold line defined at a top edge of first side wall 1606. Closure lip 1442 of inner top panel 1440, not visible in the view of FIG. 22, engages with first side wall 1606 to maintain inner top wall 1614 in a closed orientation. To open fully open container 1600 (e.g., to transition to the fully open configuration shown in FIG. 23), the user may engage access cutout 1480 in inner top wall 1614 (e.g., using a finger), exerting an outward force relative to cavity 1620, and rotating inner top wall 1614 around a fold line at a top edge of second side wall 1610 to expose cavity 1620. Additionally or alternatively, the user may engage access cutout 1464 in front wall 1604 to open inner top wall 1614, in a similar fashion.

To close container 1600, inner top wall 114 is rotated about the fold line at the top edge of second side wall 1610 towards cavity 1620, into a substantially parallel relationship with bottom wall 1612. Closure lip 1442 extending from inner top wall 1614 engages first side wall 1606 to releasably close inner top wall 1614 and substantially cover cavity 1620. Envelope 1616 is rotated about the fold line at the top edge of first side wall 1606 towards cavity 1620 into a face-to-face relationship with inner top wall 1614. Top wall 1602 is rotated into a substantially parallel relationship with bottom wall 1612, covering inner top wall 1614 and envelope 1616. Closure lip 1452 extending from top wall 1602 engages front wall 1604 to releasably close container 1600.

Figure 25:
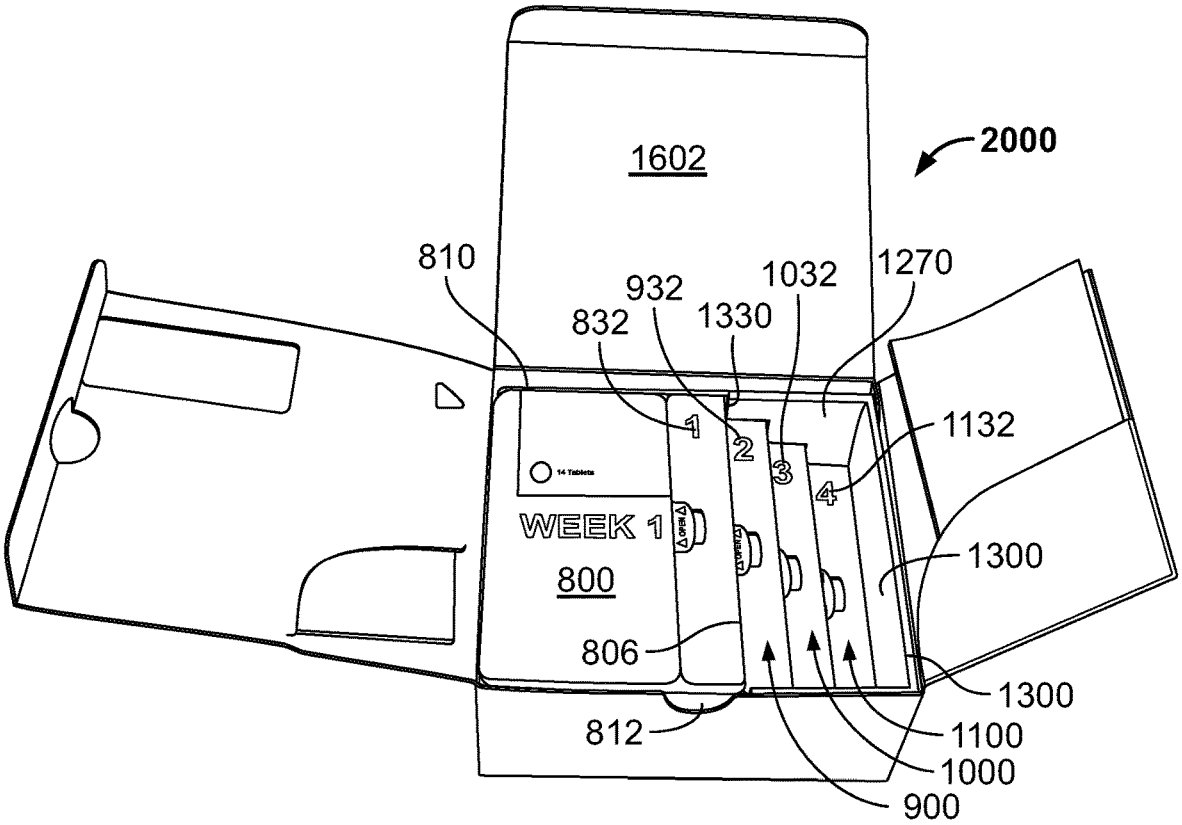
Figure 27:
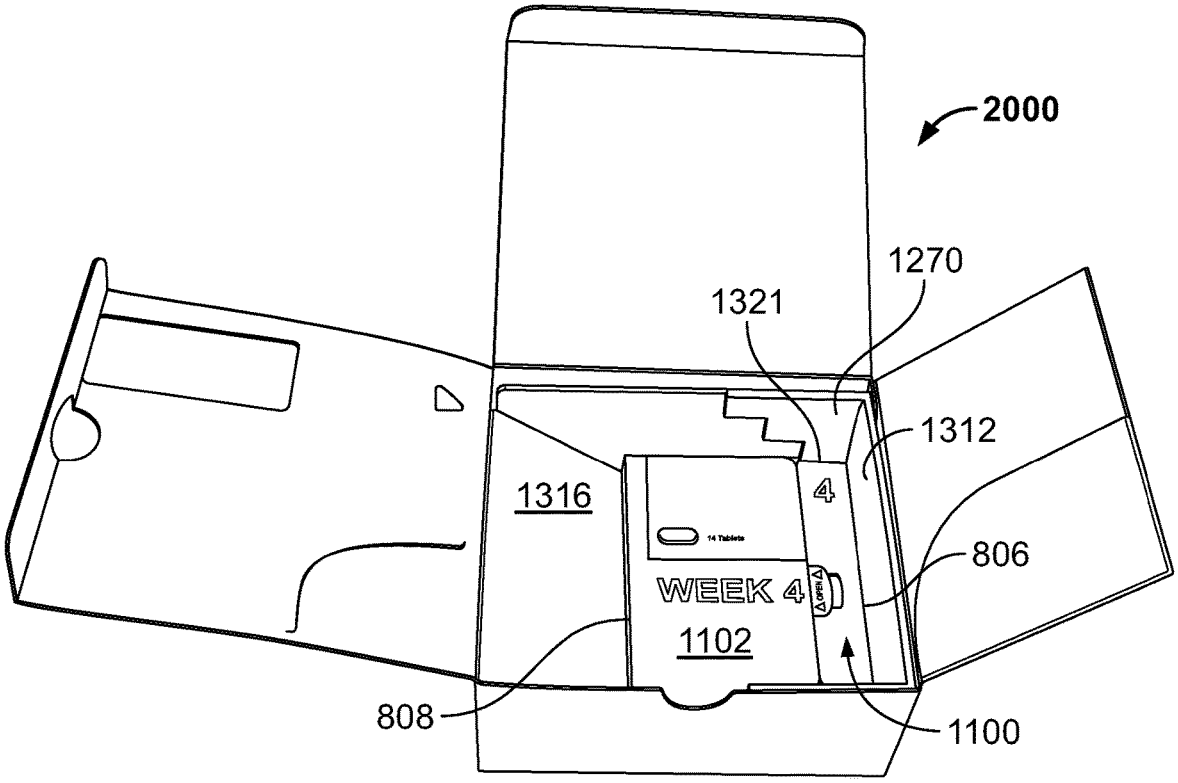
Figure 28:
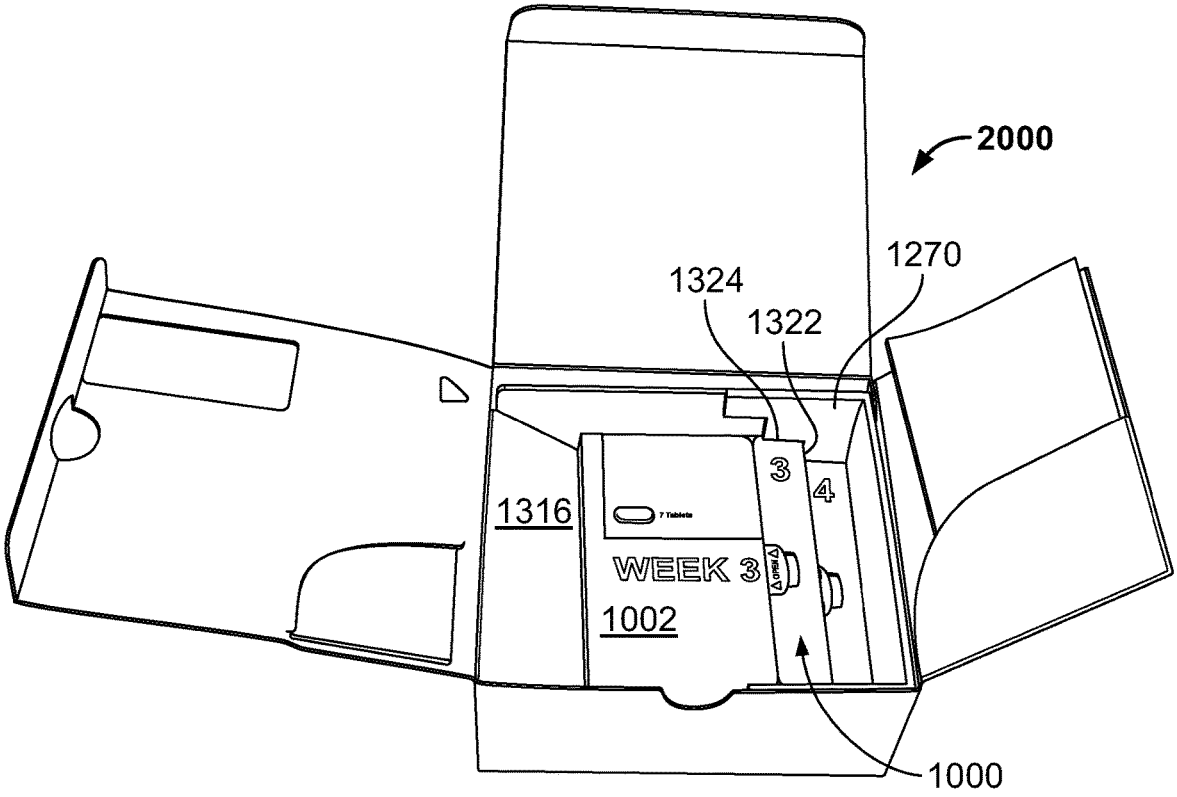
Figure 29:
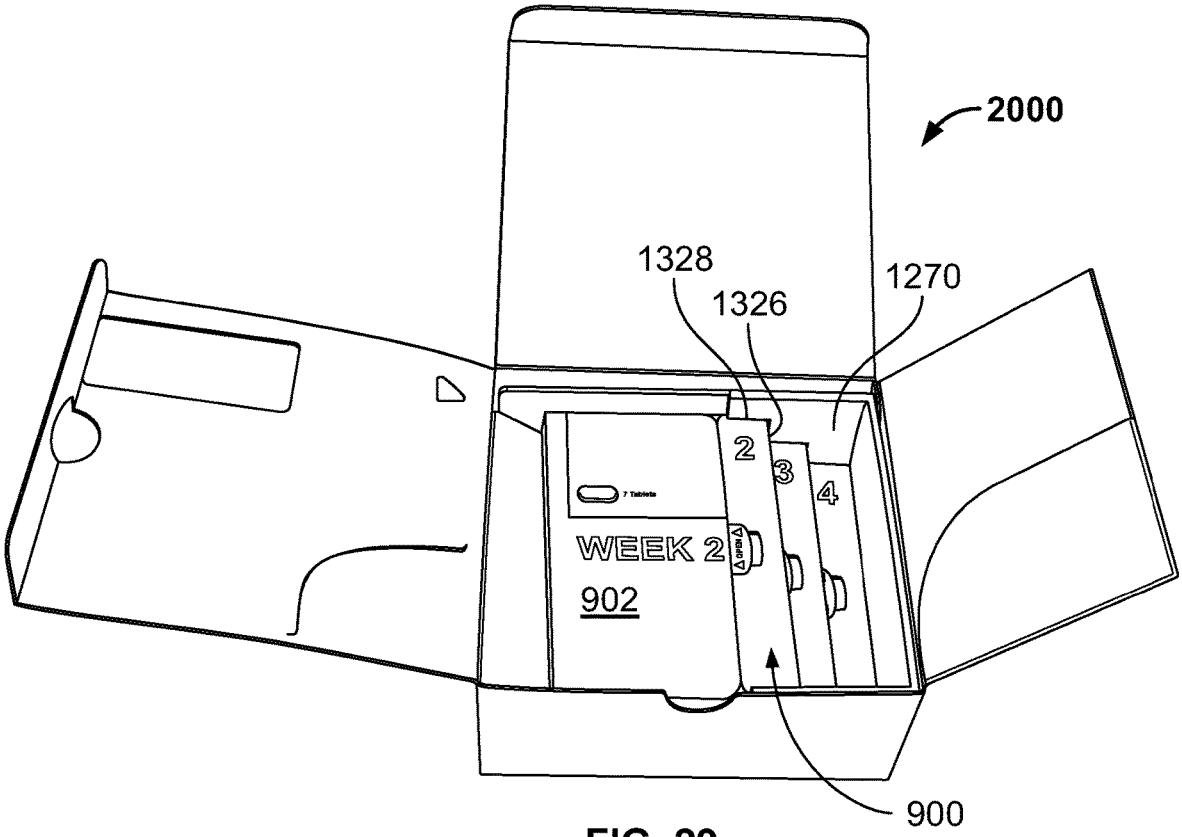

FIGS. 24-29 illustrate various perspective views of a system 2000 for medication packaging and dispensing, system 2000 including container 1600 (shown in FIGS. 21-23), tray 1300 (shown in FIG. 19), and medication booklets 800, 900, 1000, and/or 1100 (shown in FIGS. 11-17B). FIG. 24 is a perspective view of system 2000 in an intermediate open configuration. FIG. 25 is a first view of system 2000 in a fully open configuration, illustrating a "full" or "complete" system 2000, FIG. 26 is a second view of system 2000 in the fully open configuration, illustrating an "empty" system 2000 (e.g., without any medication booklets contained therein), FIG. 27 is a third view of system 2000 in the fully open configuration, in a "first packaging stage" or "final dispensing stage," FIG. 28 is a fourth view of system 2000 in the fully open configuration, illustrating an "intermediate packaging stage" or "intermediate dispensing stage," and FIG. 29 is a fifth view of system 2000 in the fully open configuration, illustrating another "intermediate packaging stage" or "intermediate dispensing stage."

Referring to FIG. 24, in which system 2000 is in the intermediate open configuration, envelope 1616 of container 1600 includes materials 2002 retained therein. Materials 2002 may be educational or instructional materials, safety guidelines, warnings, a "quick start guide," medication information, or any other materials 2002 relevant to medication packaging and dispensing system 2000. Inner top wall 1614 of container 1600 also includes materials 2004 retained therein. More specifically, corner catch 1472 and corner anchor 1474 cooperate to engage and retain materials 2004. In one embodiment, inner top wall 1614 includes indicia (not shown) printed thereon instructing a user of system 2000 to view materials 2004 and/or 2002 prior to opening inner top wall 1614. Window 1470 defined in inner top wall 1614 exposes a view of medication booklets 800, 900, 1000, and 1100, in a staggered configuration in tray 1300. Closure lip 1442 of inner top wall 1614, not visible in the view of FIG. 24, engages with first side wall 1606 of container 1600 and/or first side wall 1312 of tray 1300 to retain inner top wall 1614 in a closed configuration.

Referring now to FIG. 25, inner top wall 1614 of container 1600 is rotated away from cavity 1620 of container 1600, exposing medication booklets 800, 900, 1000, 1100 retained in tray 1300. Medication booklets 800, 900, 1000, 1100 are in a staggered configuration in tray 1300, enabling a user to view all of medication booklets 800, 900, 1000, 1100 at once, and ensuring the user accesses medication booklets 800, 900, 1000, 1100 in the proper order. For example, each medication booklet's 800, 900, 1000, 1100 sequence number 832, 932, 1032, 1132 is visible in the staggered configuration.

Tray 1300 is configured to retain the plurality of medication booklets 800, 900, 1000, and 1100 therein in the staggered configuration. In the illustrated embodiment, tray 1300 is configured to retain one, two, three, or four of medication booklets 800, 900, 1000, and/or 1100 therein. With reference to FIG. 27, a "bottom" medication booklet (medication booklet 1100, in the example embodiment) may be inserted into tray 1300 in a first packaging stage of system 2000. Bottom medication booklet 1100 rests on bottom wall 1314 of tray 1300. More particularly, an exterior surface of bottom wall 1104 of bottom medication booklet 1100 engages in a face-to-face relationship with an interior surface of bottom wall 1314 of tray 1300. First end wall 810 of bottom medication booklet 1100 may engage in a face-to-face relationship with back wall 1310 of tray 1300, and/or second end wall 1812 of bottom medication booklet 1100 may engage in a face-to-face relationship with front wall 1308 of tray 1300. First side wall 806 of bottom medication booklet 1100 may engage first side wall 1312 of tray 1300, and a bottom edge of second side wall 808 of bottom medication booklet 1100 may engage bottom wall 1314 of tray 1300, fold line 1224 between bottom wall 1314 and riser 1316, and/or riser 1316. A first horizontal stop 1321 of first guide panel 1270 and a corresponding first horizontal stop (not shown) of second guide panel 1272 may engage top wall 1102 of bottom medication booklet 1100.

As shown in FIG. 28, another medication booklet, an "intermediate bottom" medication booklet (medication booklet 1000, in the example embodiment), may be inserted into tray 1300 in a second packaging stage of system 2000. Intermediate bottom booklet 1000 does not vertically align with bottom booklet 1100 but rather is forced into a staggered configuration with respect to bottom booklet 1100. A first vertical stop 1322 of first guide panel 1270 and a corresponding first vertical stop (not shown) of second guide panel 1272 engage first side wall 806 of intermediate bottom booklet 1000 at a distance from first side wall 1312 of tray 1300 that corresponds to a length of first horizontal stop 1321. In the illustrated embodiment, this distance facilitates simultaneous viewing of sequence numbers 1032, 1132 of medication booklets 1000, 1100. A second horizontal stop 1324 of first guide panel 1270 and a corresponding second horizontal stop (not shown) of second guide panel 1272 may engage top wall 1002 of intermediate bottom medication booklet 1000. A portion of bottom wall 1004 of intermediate bottom booklet 1000 rests on and engages with top wall 1102 of bottom booklet 1100. Additionally, a bottom edge of second side wall 808 of intermediate bottom medication booklet 1000 engages riser 1316. The oblique angle of riser 1316 with respect to bottom wall 1314 of tray 1300 corresponds to an "angle" of the "steps" of guide panels 1270, 1272, or the general pitch 1293 of guide panels 1270, 1272, such that riser 1316 maintains medication booklets 1100, 1100 in a substantially parallel relationship with bottom wall 1314.

Similarly, as shown in FIG. 29 another medication booklet, an "intermediate top" medication booklet (medication booklet 900 in the example embodiment), may be inserted into tray 1300 in a third packaging stage of system 2000. Intermediate top medication booklet 900 does not vertically align with intermediate bottom medication booklet 1000 but rather is forced into a staggered configuration with respect to intermediate bottom medication booklet 1000. A second vertical stop 1326 of first guide panel 1270 and a corresponding second vertical stop (not shown) of second guide panel 1272 engage first side wall 806 of intermediate top medication booklet 900 at a distance corresponding to a length of second horizontal stop 1324. A third horizontal stop 1328 of first guide panel 1270 and a corresponding third horizontal stop (not shown) of second guide panel 1272 may engage top wall 902 of intermediate top medication booklet 900. A portion of bottom wall 904 of intermediate top booklet 900 rests on and engages with top wall 1002 of intermediate bottom booklet 1000. Additionally, a bottom edge of second side wall 808 of intermediate top medication booklet 900 engages riser 1316, which maintains intermediate top medication booklet 900 in a substantially parallel orientation with respect to bottom wall 1314.

With reference now to FIG. 25, in the illustrated embodiment, a fourth, final medication booklet, a "top" medication booklet (medication booklet 800, in the example embodiment), may be inserted into tray 1300 in a fourth or final packaging stage of system 2000. Top medication booklet 800 does not vertically align with intermediate top bottom booklet 900 but rather is forced into a staggered configuration with respect to intermediate top medication booklet 900. A third vertical stop 1330 of first guide panel 1270 and a corresponding third vertical stop (not shown) of second guide panel 1272 engage first side wall 806 of top medication booklet 800 at a distance corresponding to a length of third horizontal stop 1328. In the illustrated embodiment, top wall 802 of top medication booklet 800 is substantially coplanar with a top edge 1350 of tray 1300, as defined by back wall 1310, first side wall 1312, and front wall 1308 of tray 1300. Additionally, a bottom edge of second side wall 808 of top medication booklet 800 engages top edge 1320 (shown in FIG. 19) of second side wall 1318 of tray 1300.

It should be understood that medication booklets 800, 900, 1000, and 1100 may be removed from system 2000 (e.g., from tray 1300) in "dispensing stages" of opposite order to the "packaging stages" described above. The user may access top medication booklet 800 by removing it from tray 1300. Top medication booklet 800 may be removed from tray 1300 by engaging first side wall 806 of top medication booklet 800 and withdrawing top medication booklet 800 vertically from tray 1300. Removing top medication booklet 800 enables access to intermediate top booklet 900 in tray 1300. Intermediate top booklet 900 (and subsequent medication booklets 1000 and 1100) may be removed from tray 1300 by sliding medication booklet 900 away from guide panels 1270, 1272, such that the bottom edge of second side wall 808 of medication booklet 900 "slides up" riser 1316 to be withdrawn vertically from tray 1300. The sequence of "dispensing" or subsequent access to medication booklets 1000 and 1100 continues, until bottom medication booklet 1100 is removed.

It should be understood that although the illustrated embodiment of medication packaging and dispensing system 2000 includes functionality for retaining, packaging, and displaying four medication booklets, system 2000 may be scaled up or down to retain and display fewer or additional medication booklets, or alternatively sized, shaped, or configured medication booklets, as required by a particular course of treatment. In addition, it should be understood that although the illustrated embodiment of medication packaging and dispensing system 2000 includes functionality for retaining, packaging, and displaying medication booklets, system 2000 may be modified to hold a medication and/or other products which may require adherence to a particular order.

This written description uses examples to disclose the embodiments, including the best mode, and also to enable any person skilled in the art to practice the disclosure, including making and using any devices or systems and performing any incorporated methods. The patentable scope of the embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tray comprising:

a first end wall;

a first side wall extending from a side edge of said first end wall;

a bottom wall extending from a bottom edge of said first side wall;

a riser extending an oblique angle from said bottom wall; and a first guide panel coupled in a face-to-face relationship with said first end wall, said first guide panel comprising a plurality of linear stops along a free edge thereof, wherein the oblique angle of said riser corresponds to a pitch of said first guide panel.

2. The tray of claim 1, wherein said plurality of linear stops is configured to receive a product, and wherein said riser and at least one of said plurality of linear stops of said first guide panel cooperate to hold each product of the tray in a staggered configuration parallel to said bottom wall.

3. The tray of claim 1 further comprising:

a second, opposing end wall; and a second guide panel coupled in a face-to-face relationship with said second end wall, said second guide panel comprising a plurality of linear stops along a free edge thereof, said plurality of linear stops of said first guide panel aligned with said plurality of linear stops of said second guide panel.

4. The tray of claim 1 wherein an inner panel of said first side wall defines a gap between a first end edge of said inner panel and an interior surface of said first end wall, said first guide panel retained in said gap.

5. The tray of claim 4, further comprising:

a second, opposing end wall; and a second guide panel coupled in a face-to-face relationship with said second end wall, said second guide panel comprising a plurality of linear stops along a free edge thereof, said plurality of linear stops of said first guide panel aligned with said plurality of linear stops of said second guide panel, wherein said inner panel of said second end first side wall defines a second gap between a second end edge of said inner panel and an interior surface of said second end wall, said second guide panel retained in the second gap.

6. The tray of claim 1 further comprising a second, opposing side wall extending from said riser opposite said bottom wall, said second side wall maintaining said riser at the oblique angle.

7. The tray of claim 6, further comprising a pair of support flaps, each said support flap extending inwardly from said second side wall.

8. The tray of claim 7, wherein said pair of support flaps is retained within a cavity defined by said riser, said second side wall, said first end wall, a second, opposing end wall, and said bottom wall.

9. The tray of claim 7, wherein a locking slot is defined between a first end edge of said second side wall and a first support flap of said pair of support flaps, wherein a side locking tab extends from a second side edge of said first end wall and is retained in the locking slot to maintain a perpendicular relationship between said second side wall and said first end wall.

10. The tray of claim 7, wherein a respective top edge of each said support flap is angled at the oblique angle and is in edge-to-face contact with a bottom surface of said riser, to support and maintain said riser at the oblique angle.

11. The tray of claim 1, wherein each linear stop of said plurality of linear stops is perpendicular to at least one adjacent linear stop of said plurality of linear stops.

12. The tray of claim 1, further comprising a second, opposing end wall, wherein an access cutout is formed in a top edge of said second end wall.

* * * * *